US007503196B2

(12) United States Patent
Chitty et al.

(10) Patent No.: US 7,503,196 B2
(45) **Date of Patent: *Mar. 17, 2009**

(54) RIVET MONITORING SYSTEM

(75) Inventors: Eymard J. Chitty, Easton, CT (US); Brian M. Taylor, Glastonbury, CT (US); Peter C. Thomas, Cheshire, CT (US); Daniel P. Vigliotti, Hamden, CT (US); Geoffrey Weeks, Burton-upon-Trent (GB)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/069,798

(22) Filed: Feb. 13, 2008

(65) Prior Publication Data

US 2008/0168816 A1 Jul. 17, 2008

Related U.S. Application Data

(63) Continuation-in-part of application No. 11/526,266, filed on Sep. 22, 2006, now Pat. No. 7,331,205, which is a continuation of application No. PCT/US2005/009461, filed on Mar. 22, 2005.

(60) Provisional application No. 60/625,715, filed on Nov. 5, 2004, provisional application No. 60/612,772, filed on Sep. 24, 2004, provisional application No. 60/589,149, filed on Jul. 19, 2004, provisional application No. 60/587,971, filed on Jul. 14, 2004, provisional application No. 60/567,576, filed on May 3, 2004, provisional application No. 60/555,989, filed on Mar. 24, 2004.

(51) Int. Cl.
*B21J 15/28* (2006.01)
*B23P 11/00* (2006.01)

(52) U.S. Cl. ..... 72/21.4; 72/20.1; 72/21.1; 72/391.4; 29/243.523; 29/243.524; 29/243.525; 700/110; 227/2

(58) Field of Classification Search ..... 72/21.1, 72/21.4, 391.4, 20.1; 29/243.523, 243.524, 29/243.525; 700/110; 227/2
See application file for complete search history.

(56) References Cited

U.S. PATENT DOCUMENTS

| | | | |
|---|---|---|---|
| 3,292,413 | A | 12/1966 | Falcioni |
| 3,665,742 | A | 5/1972 | Felt et al. |
| 4,288,901 | A | 9/1981 | Babcock |
| 4,836,003 | A | 6/1989 | Blake |
| 4,914,602 | A | 4/1990 | Abe et al. |
| 4,995,148 | A | 2/1991 | Bonomi et al. |
| 5,035,129 | A | 7/1991 | Denham et al. |
| 5,035,353 | A | 7/1991 | Smart et al. |

(Continued)

FOREIGN PATENT DOCUMENTS

| | | | |
|---|---|---|---|
| DE | 37 15 905 | A1 | 12/1988 |

(Continued)

*Primary Examiner*—David B Jones
(74) *Attorney, Agent, or Firm*—Harness, Dickey & Pierce, P.L.C.

(57) ABSTRACT

A rivet monitoring system is provided which has a micro-strain or micro fluid pressure sensor that measures strains or pressures within a tool component. These measured signals are compared to a number of tolerance bands formed about median strain or pressure versus time curve. Various techniques are provided to analyze the measured data with respect to the tolerance bands to determine if a particular rivet set is acceptable.

20 Claims, 17 Drawing Sheets

U.S. PATENT DOCUMENTS

| | | | | |
|---|---|---|---|---|
| 5,201,204 | A | 4/1993 | Hinterman et al. | |
| 5,315,744 | A | 5/1994 | Denham et al. | |
| 5,396,703 | A | 3/1995 | Rice | |
| 5,404,643 | A | 4/1995 | Rice | |
| 5,502,884 | A | 4/1996 | Ladouceur | |
| 5,526,669 | A | 6/1996 | Gjovik et al. | |
| 5,590,453 | A | 1/1997 | Gajewski | |
| 5,600,878 | A | 2/1997 | Byrne et al. | |
| 5,661,887 | A | 9/1997 | Byrne et al. | |
| 5,666,710 | A | 9/1997 | Weber et al. | |
| 5,673,839 | A | 10/1997 | Howard et al. | |
| 6,014,804 | A | 1/2000 | Lulay et al. | |
| 6,092,275 | A | 7/2000 | Kellner et al. | |
| 6,141,849 | A | 11/2000 | Honsel et al. | |
| 6,176,000 | B1 | 1/2001 | Lulay et al. | |
| 6,240,613 | B1 | 6/2001 | O'Connor et al. | |
| 6,276,037 | B1 | 8/2001 | Solfronk | |
| 6,276,050 | B1 | 8/2001 | Mauer et al. | |
| 6,446,319 | B1 | 9/2002 | Lulay et al. | |
| 6,502,008 | B2 | 12/2002 | Maurer et al. | |
| 6,843,326 | B2 | 1/2005 | Tambini | |
| 6,871,586 | B2 | 3/2005 | Teraoka | |
| 6,892,431 | B2 | 5/2005 | Campbell et al. | |
| 6,895,793 | B2 | 5/2005 | Heffron et al. | |
| 6,951,052 | B2 | 10/2005 | Clew | |
| 6,961,984 | B2 | 11/2005 | Naito et al. | |
| 7,331,205 | B2 * | 2/2008 | Chitty et al. | 72/21.1 |
| 2003/0074102 | A1 | 4/2003 | Mauer et al. | |
| 2004/0060363 | A1 | 4/2004 | Smith | |
| 2004/0167660 | A1 | 8/2004 | Mauer et al. | |
| 2004/0189232 | A1 | 9/2004 | Cho | |

FOREIGN PATENT DOCUMENTS

| | | | |
|---|---|---|---|
| DE | 4217901 | | 12/1993 |
| DE | 44 01 155 | A1 | 7/1995 |
| DE | 100 64 243 | A1 | 7/2002 |
| DE | 202 10 840 | U1 | 7/2003 |
| EP | 462707 | A2 | 12/1991 |
| EP | 0 594 333 | A1 | 4/1994 |
| EP | 0 738 550 | A2 | 4/1996 |
| EP | 0 738 551 | A2 | 10/1996 |
| EP | 0 905 518 | A2 | 4/2000 |
| EP | 0 995 519 | A2 | 4/2000 |
| EP | 1 382 406 | A2 | 1/2004 |
| EP | 1447157 | A1 | 8/2004 |
| EP | 1 506 846 | A1 | 2/2005 |
| JP | 62-77146 | | 4/1987 |
| JP | 04169828 | A | 6/1992 |
| JP | 6-190489 | | 7/1994 |
| JP | 7-015135 | | 3/1995 |
| WO | WO00/21700 | | 4/2000 |
| WO | WO02/43898 | | 6/2002 |
| WO | WO03/000445 | | 1/2003 |
| WO | WO03/059550 | | 7/2003 |
| WO | WO03/059551 | | 7/2003 |

* cited by examiner

RIVET MONITORING SYSTEM

CROSS-REFERENCE TO RELATED APPLICATIONS

This application is a continuation of U.S. patent application Ser. No. 11/526,266, filed Sep. 22, 2006, which is a continuation of PCT International Application No. PCT/US2005/009461, filed Mar. 22, 2005, which claims the benefit of U.S. Provisional Applications Ser. No. 60/555,989 filed Mar. 24, 2004, Ser. No. 60/567,576 filed May 3, 2004, Ser. No. 60/587,971 filed Jul. 14, 2004, Ser. No. 60/589,149 filed Jul. 19, 2004, Ser. No. 60/612,772 filed Sep. 24, 2004, and Ser. No. 60/625,715 filed Nov. 5, 2004. The disclosures of the above applications are incorporated herein by reference.

FIELD OF THE INVENTION

The present invention relates to a method for detecting and monitoring a rivet setting process to determine the acceptability of the rivet being set through the use of micro-strain or pressure sensor technology for automatic, semi-automatic and manual rivet setting tools.

BACKGROUND AND SUMMARY OF THE INVENTION

Mechanical assemblies often use fasteners and typically blind rivets to secure one or more components together in a permanent construction. Blind rivets are preferred where the operator cannot see the blind side of the workpiece for instance where the rivet is used to secure a secondary component to a hollow box section. Also they are preferred where a high volume of assemblies are being produced as there are advantages to be gained from increased assembly speeds and productivity compared with say threaded or bolted joints.

One of the disadvantages of a blind rivet setting to a hollow box section is that the blind side set end of the rivet cannot be visually inspected for a correctly completed joint. This is especially relevant where there are a number of blind rivets used and these are of a multiplicity of different sizes both in diameters and lengths. Also there could be occasions where assembly operators are inexperienced or the arrangements of rivets are complex. Further, it is possible that rivets are incorrectly installed or perhaps not installed at all. To inspect assemblies after completion is not only expensive and unproductive and in some instances it is virtually impossible to identify if the correct rivet has been used in a particular hole. A further consideration can be that modern assembly plants are using increasing numbers of automative rivet placement and setting tools where there is an absence of the operator.

The current monitoring of a rivet during the setting process has been limited to the use of two methods. The first method employs the use of a hydraulic pressure transducer which measures working fluid pressure within the tool. This current method is limited to use in detecting fluid pressure alone. The second method uses a "load cell" mounted linear to the tool housing. This option used equipment which is considerably larger in size and has limited field capability as a result. Typically, the second method additionally uses a LVDT to measure the translations of the various moving components.

In accordance with the present invention, a system is provided that will continually monitor the setting process, the numbers of rivets set and the correctness of setting and to identify if there are small but unacceptable variations in rivet body length or application thickness. Also, because assembly speeds are increasing, it is an advantage to identify incorrect setting almost immediately instead of a relatively long delay where complex analysis of rivet setting curves is used. Other fasteners such as blind rivet nuts (POP®nuts), self drilling self tapping screws or even specialty fasteners such as POP®bolts can be monitored but for the purposes of this invention blind rivets are referred to as being typical of fasteners used with this monitoring system.

To overcome the disadvantages of the prior art, a rivet monitoring system is provided which has a micro-strain sensor that measures strains within a tool component. These measured strains are compared to a number of tolerance bands formed about median strain or pressure versus time curve. Various techniques are provided to analyze the measured data with respect to the tolerance bands to determine if a particular river set is acceptable. Additional advantages and features of the present invention will become apparent from the following description and appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses. The system is configured to confirm the quality of the setting process and of the resultant set. The system uses a rivet setting machine having a first member configured to apply a setting force to a fastener to set the fastener. A coupling structure is provided which is configured to apply reaction forces to the fastener in response to the setting force. A sensor is attached to the coupling structure for sensing changes in physical parameters within said coupling structure induced by the reaction forces.

The first member applies the setting force along an axis to a first side of the fastener and the setting force is resisted by a second member which applies a reaction force generally parallel to setting force. This reaction force is caused by elastic deformation in the coupling structure.

The sensor is configured to measure strain at a location which is a predetermined radial distance from the axis. As described below, the sensor is located at a location on the coupling or support structure which is susceptible to stains induced by moments caused by the reaction force. Because of its location, the sensor is capable of being calibrated to indicate changes in physical parameters that can be displayed in comparative terms. Further, because of its location, the sensor need not be calibrated after routine maintenance such as the changing of dies or punch components.

Figure 1A:
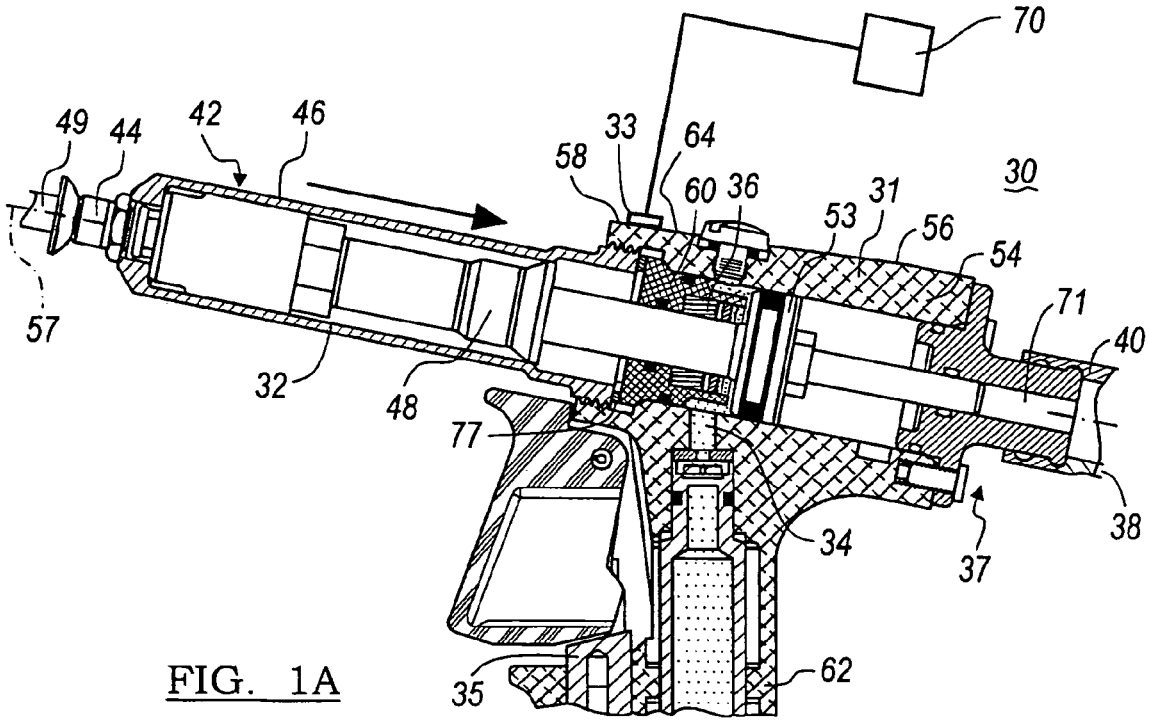
FIGS. 1*a* and 1*b* represent cross-sectional views of a rivet setting tool according to the teachings of the present invention.
Figure 1B:
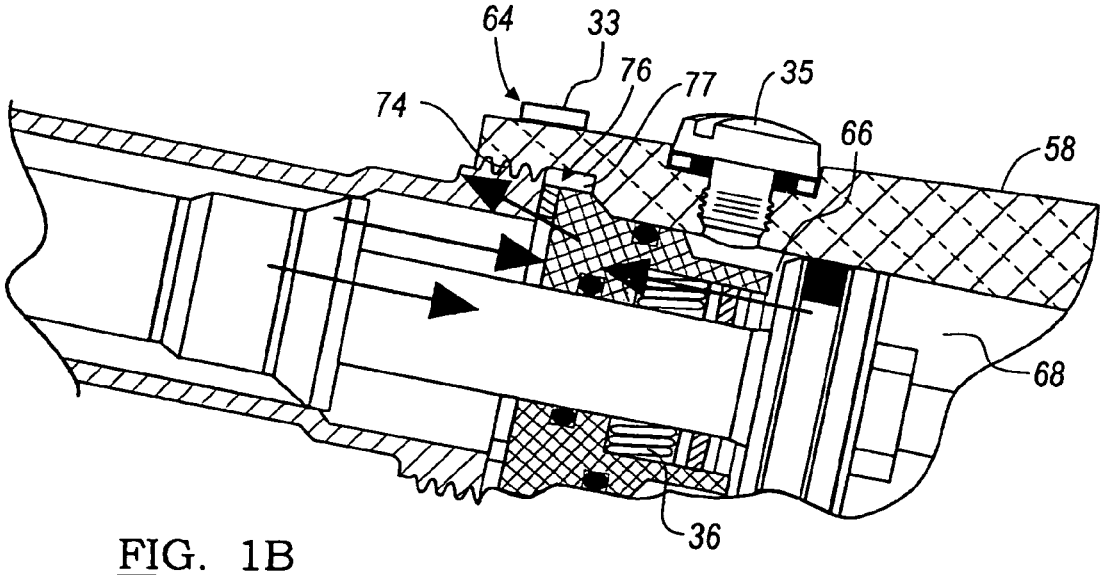

FIGS. 1*a* and 1*b*, show a rivet setting tool 30 having a rivet quality set detection system 32 according to the teachings of the present invention, preferably for use with a blind rivet with a pull system. Rivet setting tool 30 has a housing 31, a mandrel pulling mechanism 32, and a micro-strain sensor 33. Sensor 33 is coupled to a surface of the rivet setting tool. Sensor 33 is configured to measure micro-strains within components of rivet setting tool 30 during a rivet setting event. Additionally, the rivet setting tool has a monitoring circuit configured to receive a number of training output signals from the sensor 33. The circuit combines the training output signal to form a representative array of data and defines a tolerance bands about the representative data. These tolerance bands may be about at least one data point in the representative array of data, and may be in either the time or strain domain.

The front end of the tool has a mandrel pulling mechanism 42 which is generally comprised of a nose piece 44, a nose housing 46, and a pulling head adaptor 48. Pulling head adapter 48 is coupled to a movable pulling piston 53 found in a body housing 54. Body housing 54 defines a generally thick-walled-cast cylinder 56 which annularly envelopes piston 53 of mandrel pulling mechanism 42. Housing 54, which is defined by a longitudinal axis 57 has an exterior surface 58, an interior surface 60, and a handle portion 62. Housing body 54 has a surface which has a specific sensor mounting location 64 which is preferably anywhere along exterior surface 58 of thick-walled-cast cylinder 56. In this regard, it is envisioned that sensor mounting location 64 can be positioned along the top or along the sides of mandrel rivet tool 30. Sensor mounting location 64 is a defined slot which is machined into either the interior or exterior surface of the cast housing wall. Optionally, the thickness of the metal between the inside surface and the exterior surface can be a defined value. Micro-strain sensor 33, which is described below, is preferably positioned parallel to longitudinal axis 57 of housing 54 and configured to measure physical properties of the body during a rivet setting event. Specifically, the sensor 33 is configured to measure strains in the body induced by moments formed by the setting of the fastener.

Elongated cylindrical body 56 of body housing 54 includes an aperture defined at its fore end through which mandrel pulling mechanism 43 is coupled to moveable piston 53 passes. Housing 56 is internally subdivided by movable piston 53 into fore and aft chambers 66 and 68. As best seen in FIG. 1*b*, a threaded coupling 74 couples nose housing 46 and cast body 54. In this regard, nose housing 46 is engaged into cast body 54 until it reaches a retaining ring 76. Adjacent to retaining ring 76 is a handle counter bore or annular cavity 77. Counter bore 77 is optionally located adjacent or beneath sensor mounting location 64. The portion of cast body 54 between exterior surface 58 and counter bore 77 has a relatively thin cross-sectional thickness which will have increased strains which are caused by the forces induced through the threaded coupling 74.

A jaw assembly includes a set of mandrel gripping jaws (not shown) contained within jaw case 46 and is connected to pulling head adaptor 48. During the setting operation the jaws engage and grip an elongated stem of a mandrel of a blind rivet 49.

Upon initiation of the rivet setting cycle, air fluid is admitted to an air cylinder (not shown) of the setting tool and, in turn, hydraulic oil fluid is pressurized and forced through orifice 34 and into forward chamber 66 of housing 54. As the hydraulic oil continues to be forced into this forward chamber, it forces actuating piston 53 rearwardly and, since it is connected to mandrel pulling head adapter 48 and, in turn, mandrel pulling mechanism 42, it also draws the mandrel gripping jaws and associated rivet mandrel 50 rearwards to set the rivet. The injection of hydraulic oil under pressure into the cavity 66 not only moves actuating piston 53, it also imposes an equal internal pressure in rivet setting tool body housing 54. This internal pressure varies during the process of setting of the rivet and thus induces varying and minute changes in dimension and therefore varying strain within housing 54.

These varying dimensions within housing body 54 elastic micro-strains are measured by the sensor 33. During the collection of the strain data from the load-measuring device the data is processed by a programmable microprocessing based controller 70 which uses a software program to compare changes in the strain gauge to calculate changes in pressure, strain or stress against time or distance as the jaws travel during a rivet setting operation. The sensor 33 may be a piezoelectric sensor or a traditional single or multiple resistance strain gauge device. This is repeated for each rivet and, therefore a setting history can be prepared and compared against a desired range of values that has previously been established and stored in a memory of processor 70.

Figure 2A:
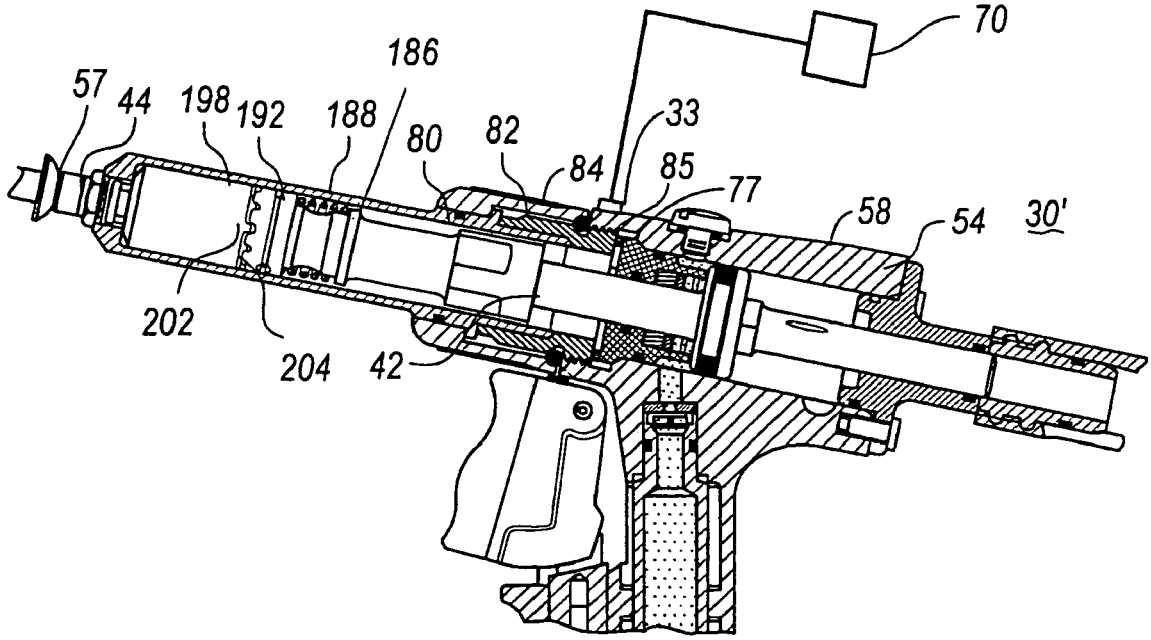
FIGS. 2*a* and 2*b* represent cross-sectional views of an alternate rivet setting tool according to the teachings of the present invention.
Figure 2B:
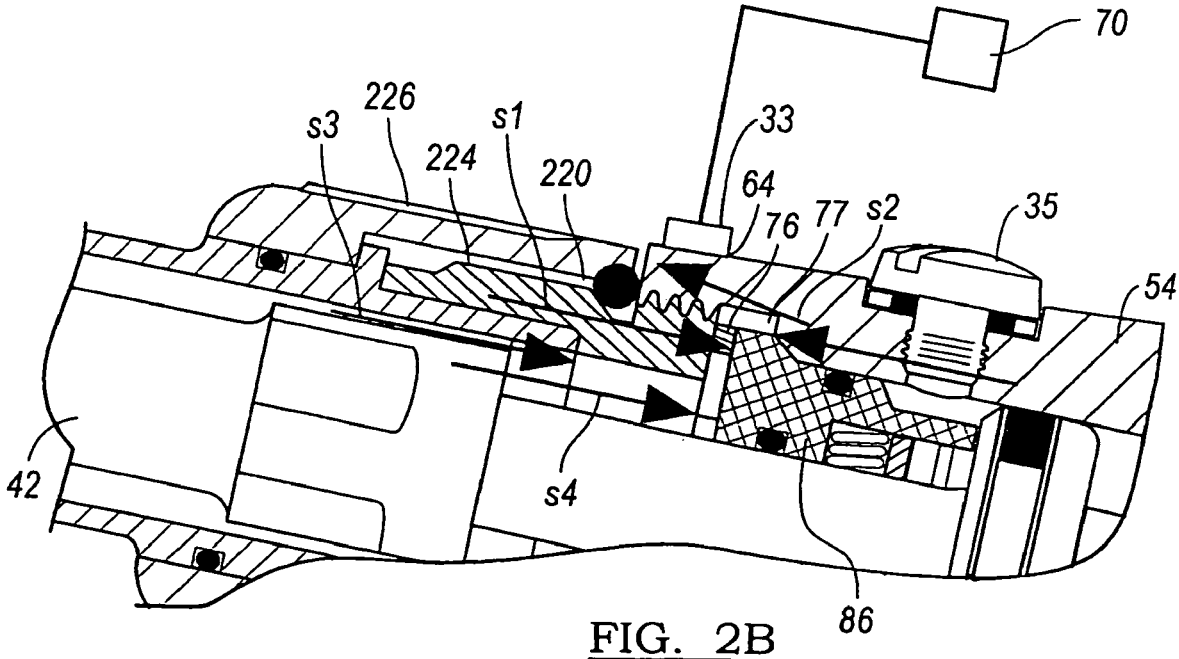

FIGS. 2*a* and 2*b* represent an alternate rivet setting tool 30' according to the teachings of the present invention. Rivet setting tool 30' utilizes a quick change nose housing 80 that allows for quick access of the jaw assembly to perform routine service. The quick change nose housing 80 is coupled to an adapter 82 utilizing a nose housing nut 84. The adapter 82 is coupled to a threaded coupling 85 formed by cast body 54. In this regard, adapter 82 is threaded into cast body 54 until it reaches a retaining ring 76. As best shown in FIG. 2*b*, a handle counter bore 77 is located adjacent to retaining ring 76. The counter bore 77 is optionally located adjacent or beneath sensor mounting location 64. The counterbore 77 functions to support the seal sleeve 86 and retaining ring 76. The portion of cast body 54 between exterior surface 58 and counter bore 77 defines a location which will have increased strains that are caused by the stress induced through the threaded coupling 74.

Stresses are induced into the cast housing from various sources. A first stress S1 is induced into cast body 54 by the tightening of the adaptor 82 to cast body 54. A second stress S2 is caused by forces from nose housing 80 during a rivet setting operation into adaptor 82, which are, in turn, transmitted through threaded region into cast body 54. A third stress S3 is caused by forces during a rivet set from nose housing 80 into adaptor 82, which are, in turn, transmitted through retaining ring 76 into cast body 54 through handle counter bore 77. A fourth stress S4 is transmitted to the cast body when head pulling adapter 82 strikes the retaining ring 76.

The retraction of the mandrel setting mechanism 42 causes forces from nose housing 80 to enter into the threadably coupled cast body 54. The transmitted forces from nose housing 80 cause micro-elastic compression of the thick-walled-cast cylinder, causing strains within the cylinder walls of cast body 54. Further, the increased air pressure from the piston and cylinder configuration of mandrel pulling mechanism 42 causes fluctuations in hoop strain within the thick-walled-cast cylinder. Generally, the combination of these strains can be described by complex tensor stress and strain fields. As body 54 of the rivet gun is a cast structure having variable thicknesses and material properties, and the setting of a rivet is a variable in terms of imposed forces and time, it is not practical to obtain an exact correlation between the measured changes in resistance in the strain gauge and associated strain and stresses within cast body 54 for a given rivet set to the forces put on a rivet. This issue is further compounded by the way the nose housing is coupled to the body, as the threaded coupling induces variable non-predictable stresses and strains into the system. This said, system 32 described above uses various methods which overcome these issues to minimize these otherwise spurious and generally arbitrary signals to analyze a rivet setting event to provide an indication of the quality of a rivet set using only changes in the row sensor signal.

With reference to FIGS. 2*a* and 2*b*, nose housing 80 covers jaw guide assembly 81 which is in communication with piston 44 via pulling head adapter 46. Nose housing 18 also includes nosepiece 80 which is fixedly attached thereto and receives a mandrel of a rivet (not shown) therethrough. Nose housing nut 34 is slidably disposed on pulling head adapter 82 and biased in a first direction by spring 188. Spring 188 seats between jaw guide collar 186 and a flange 190 disposed on pulling head adapter 192. A jaw guide 198, supporting a plurality of jaws (not shown), is threadedly or frictionally engaged with pulling head adapter 46 using the nose housing nut 84.

Due to this thread arrangement, debris is prevented from getting into the threads between jaw guide 198 and pulling head adapter 198. Thus, the jaw guide quick connect feature is maintained by allowing jaw guide 198 to be easily removed from the pulling head adapter 46.

Jaw guide collar 186 and jaw guide 198 have a ratcheting interface therebetween, created by the interaction between teeth 202 and teeth 204, such that jaw guide collar 186 must be pulled out of engagement with jaw guide 198, against the biasing force of spring 188, in order to unscrew jaw guide 198 from pulling head adapter 46. The teeth 192 have a sloped surface which, during tightening of jaw guide 198 onto pulling head adapter 46, causes teeth 202 to ride up sloped surface and thereby pressing jaw guide collar 186 against the spring force of spring 188. The jaw guide 198 and jaw guide collar 186 thereby have a ratcheting interface when jaw guide 198 is tightened onto pulling head adapter 46. In this manner, jaw guide 198 can be quickly removed and replaced for varying rivet types and/or sizes or for general cleaning and maintenance purposes by pulling back on jaw guide collar 186 and unthreading the jaw guide 198.

The assembly of nose housing 80 and jaw guide assembly 81 to housing 16 will be described in detail. Jaw guide assembly 81 is threadably attached to piston 53 on a cylindrical extension of piston 53. Nose housing 80 slides over jaw guide assembly 81, enclosing jaw guide assembly 81 therein.

The nose housing nut 84 is included which is slidable on an outside surface of nose housing 80 for holding nose housing 80 in place. Nose housing nut 84 can include an internally threaded portion 224 which interfaces with externally threaded portion 220 of recess portion 216 and has a gripping surface 226 disposed around an outside surface. Using gripping surface 226, an operator can threadably attach nose housing nut 84 to housing 16, thus holding nose housing 80 tightly in place.

The monitoring circuit 70 is configured to receive a statistically significant number of training output signals from the sensor from the setting of a statistically significant number of fasteners. The monitoring circuit 70 then aligns the series of training outputs signals to form a series of output/time predetermined value pairs. The controller then uses these aligned series of training output signals to form an example set of output versus time signals. Typically, the monitoring circuit 70 will average the series of training output signals to form the series of output/time predetermined value pairs. The monitoring circuit 70 then forms at least one tolerance band about a portion of the output/time value pairs.

The monitoring circuit 70 is also configured to receive a measured strain output signal from sensor during a rivet setting process. This strain signal is first aligned with series output/time value pairs. This signal can be aligned by aligning a predefined strain on the measured signal with the closest strain of the example set output/time signals. Additionally, the measured strain versus time data can be scanned to determine the last local maximum strain value. This last local maximum strain value can be aligned with a last local maximum strain value of the example set of output/time signals. As described below, many analytical techniques can be used on the aligned data to determine if a particular rivet set is appropriate. The monitoring circuit 70 then sends a signal to an indicator which is operably connected to a monitoring circuit 70 for signaling to an operator the acceptability of the rivet set based on a comparison of the measured strain out put with the example strain output value pairs.

With respect to the system shown in FIGS. 2*a* and 2*b*, the pulling assembly 81 is configured to apply a force to a fastener along the longitudinal axis of the tool. A second member, or the nose housing, is configured to apply a reactionary force in response to the force applied by the first member to the fastener. The sensor is configured to measure strain in the body caused by a moment induced by the reactionary force. In this regard, the sensor 33 configured to measure strains in a body which is off-axis from the reaction forces. The sensor 33 is optionally configured to measure strains which are offset from the main force path of a member or members which apply the reaction force to the fastener.

As seen, the nose housing nut 84 couples the nose housing to the adapter. As the adapter is already pre-torqued into the body, the sensor 33 is positioned and configured to measure strains in the body induced by the transferred forces nose housing to the adapter which are independent of the amount of torque applied to the nose housing nut 84.

Figure 3:
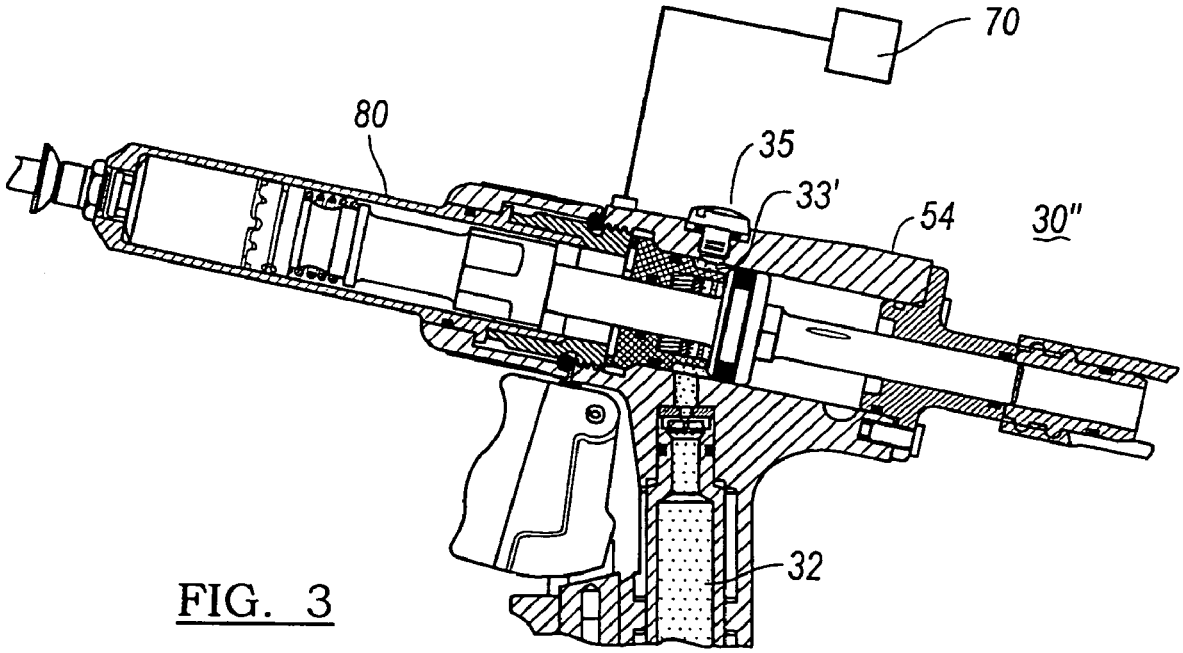
FIG. 3 represents a cross-sectional view of a rivet setting tool using a pressure sensor according to the teachings of the present invention.

FIG. 3 represents a side view of a rivet setting tool using a pressure sensor according to the teachings of the present invention. A rivet setting tool 30" used with this embodiment us similar to the rivet setting tool in FIG. 2, but tool 30" utilizes a quick change nose housing 80 that allows for quick access of the jaw assembly to perform routine service. The setting tool 30" includes a miniature pressure sensor 33' positioned generally beneath a bleed/fill screw 35 which is configured to measure hydraulic pressure within the tool.

As previously mentioned, stresses are induced into the cast housing from compression of various components which are in turn transmitted through the threaded region into the cast body 54 (see FIG. 2B). These transmissions result in compression of the hydraulic fluid which closely mirrors the micro-strains of the previous examples. The retraction of the mandrel setting mechanism forces from the nose housing 80 to compress the hydraulic fluid within the cast body 54. The system 32 described uses various methods to analyze the generally arbitrary strain and pressure signals to provide an indication of rivet set quality.

Furthermore, the system can be used to conduct a number of various analysis techniques on the data provided. The system compiles a standard setting profile for each type of rivet, and has a "self learning" capability to set the parameters for monitoring rivet setting. The system further retains the setting histories and is configured as a comparator for single rivets or groups of rivets.

The equipment for the monitoring sensor 33 in FIG. 3 is a load-measuring device 230 such as an installed pressure transducer, load cell or piezo-electric strain gauge which is configured to measure small changes in hydraulic pressure. The load measuring device may be installed into the tool itself or into a hydraulic supply line if the tool has a remote intensifier or hydraulic supply source (not shown). In this case, the sensor load is converted into electrical signals that are supplied to the integrator of the analytical package coupled to the computer processor system.

The monitoring circuit 70 is configured to define tolerance bands which are a function of the values output predetermined pairs. In this regards, the tolerance band can be a function of time or a function of strain and are configured to ensure that a predetermined measurable quality of rivet set joint is formed based on statistical process control methodologies.

Figure 4A:
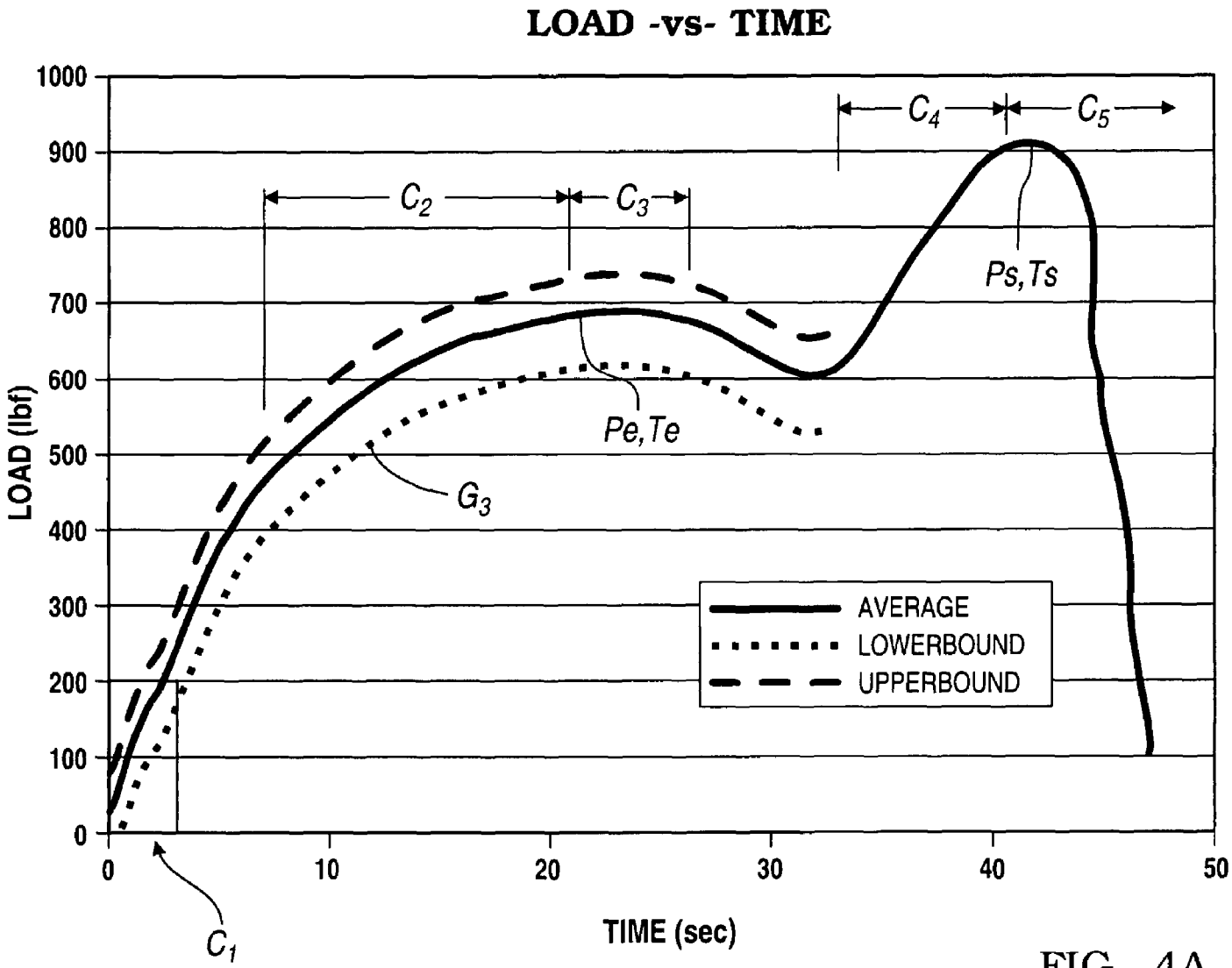
FIGS. 4*a*-4*c* represent a typical strain versus time curve measured by the sensor shown in FIGS. 1 and 2 during the setting of a rivet.
Figure 4B:
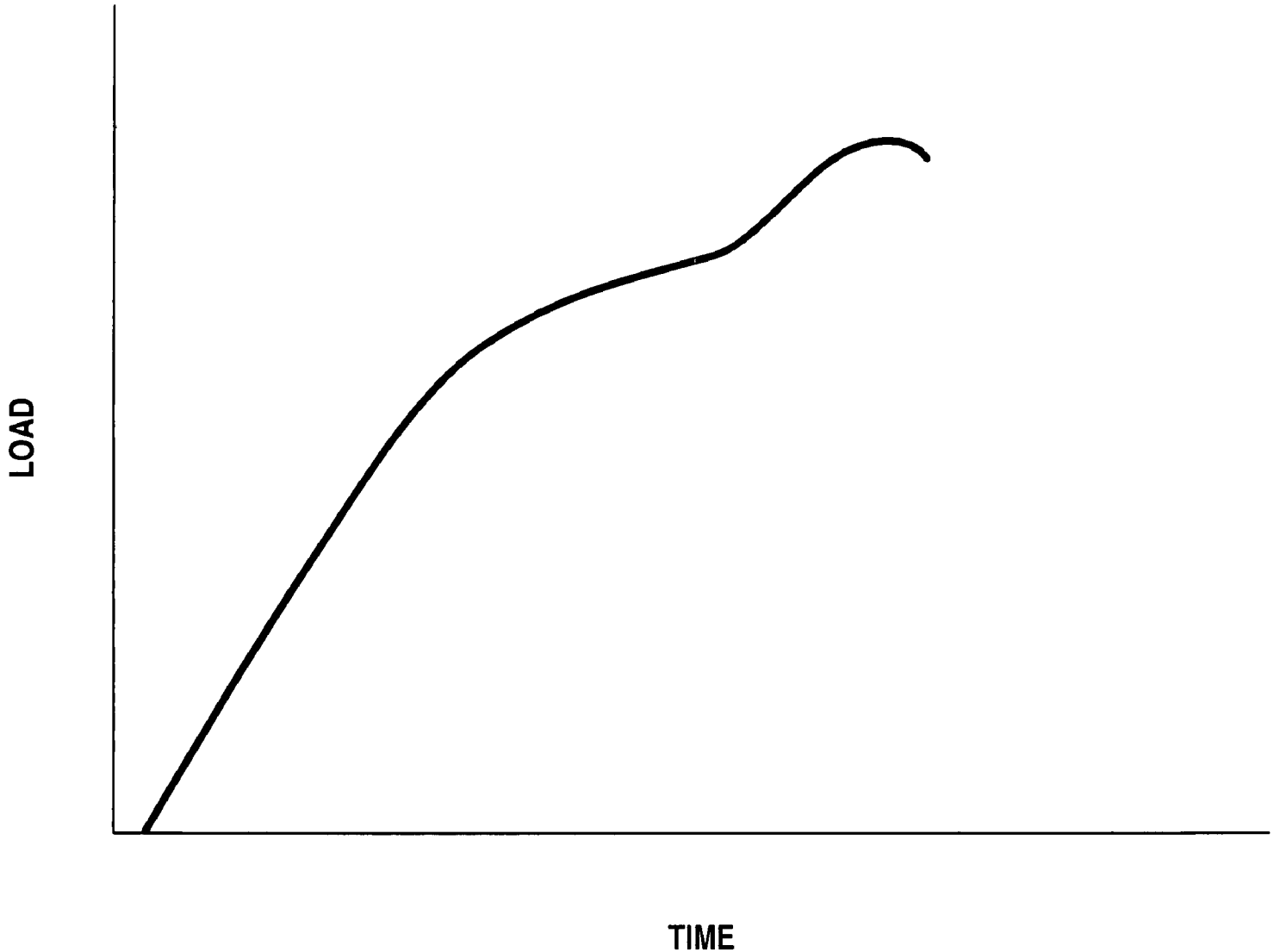

The system monitors the output from sensor 33 during the whole of the setting event and will impose a predetermined reference point on the curve to indicate the beginning or zero of the curve. It would be usual and as illustrated in this case to locate this reference point on a reference curve at a position where the curve is starting to rise from zero in order to minimize small irregularities seen in the curves due to slight mandrel pulling jaw slip or slippage in the application work process. From this located reference point a set of vertical or pressure or strain tolerances are applied to give a tolerance band through which subsequent rivet setting curves must follow. Although these tolerance bands can be applied by virtue of acquired experience it may also be derived from a calculation of the percentage of the area or work done beneath the curve and would be particularly applicable to those rivets with retained mandrel heads. Illustrations of the load versus time curves for open-end rivet type and the retained head rivet type are shown in FIGS. 4*a* and 4*b*. Although not necessary, it is preferable sensors 33' or 33 be positioned so their output signals mimic force load versus time curve for a particular set. Thus, from this reference curve a tolerance band in terms of pressure or strain for the open-end rivet type and the retained head rivet type is applied and the curves can be drawn as seen. A tolerance is applied to the maximum setting load or force in terms of incremental force or pressure and incremental distance or time to complete the construction of the reference curves.

Although, for clarity, it is assumed that there is only one rivet setting head and, therefore, only one monitoring device is used there are occasions when multiple setting heads are used. In this case and especially where the rivet setting equipment is bench mounted and static a monitoring transducer will be used at each rivet setting head.

Each rivet setting tool or groups of setting heads has associated equipment which has the processor based data manipulation system 70. The system 70 functions as an integrator that organizes and manipulates the signals from the load measuring devices so that further processing can take place. A software package with a specifically designed algorithm is installed so that data can be processed and comparisons made such as load or pressure with time or distance. This can be displayed visually in the form of a graph or curve on a suitable monitor for diagnostic purposes. Additionally, the signal can be a "red-light/green-light" or audible signal top denote status of the completed cycle. This is repeated for each rivet and, therefore, a setting history can be prepared and compared against standard.

Figure 5:
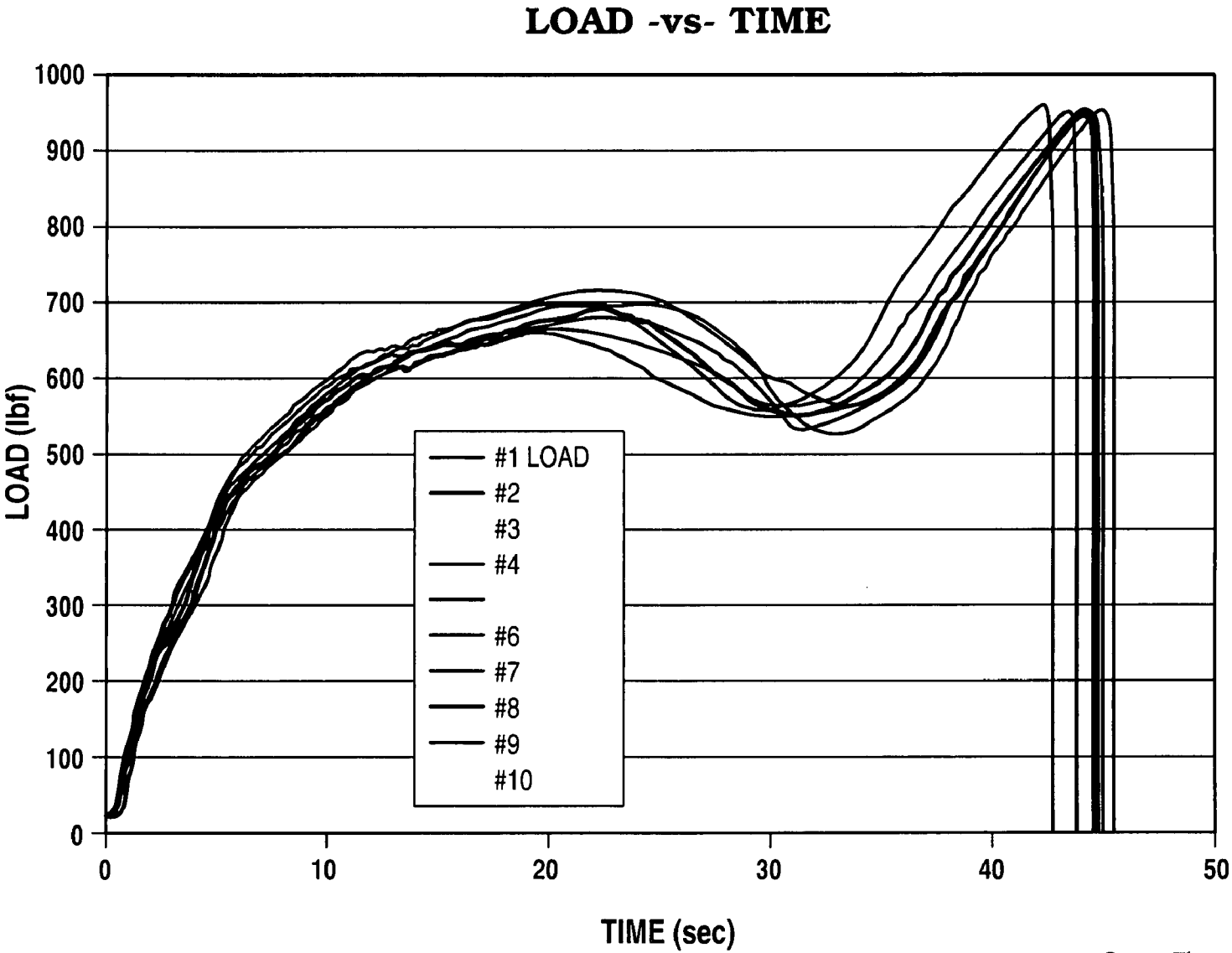
FIG. 5 represents a plurality of curves used to create an average or example strain versus time curve used by the system.

In principle, the system monitors the whole of the setting curve and compares pressure or strain with time or with distance. The system monitors and collates a number of rivet settings in the actual application in a so-called learning mode. From the collation of a number of blind rivet settings an "average" curve is produced from an average of pressure or force against displacement or time co-ordinates, as illustrated in FIG. 5.

Referring particularly to FIGS. 4*a* and 4*b* that represent typical strain or pressure versus time curves measured by the sensor shown in FIGS. 1*a*-3 during the setting of a typical rivet. While these curves may vary depending on the type of fasteners being set, generally the curves are defined by a number of distinct portions C1-C5. The first or initiation occurs when the teeth of the jaws engages the mandrel at C1. Depending on the number of sheets of material being riveted together and the spacing between them, there is often significant variation in this initial portion of the curve which is due to minute setting tool jaw slip and application sheet take-up. The second portion C2 or component adjustment portion of the curve relates to when the sheets of materials are being clamped together by the initial deformation of the rivet body as it longitudinally shortens under the setting load being applied by the mandrel. The third portion C3 of the curve is a resultant of the mandrel head entering the rivet body. The decline in the setting force or load is because the mandrel head has entered the rivet body and progressing down through the bore which gives less resistance to the setting force. The fourth portion C4 of the curve results from the rivet setting load applied to the mandrel which, having entered the rivet body and reaching the proximity of the blind side of the application workpiece, cannot proceed further and the setting load increases with application workpiece hole filling and joint consolidation taking place. The setting load increases towards the mandrel break point. The last portion C5 occurs when the mandrel break-point fractures, completing the setting of the rivet and allowing the mandrel to be ejected into the mandrel collection system.

It should be noted that depending on the type of fastener or fastener setting equipment used, different shaped curves are equally possible. Furthermore, sensor 33 used in the rivet monitoring system 32 of the present invention does not rely on the strains formed within cast body 54 of rivet setting tool 30 as a perfect or alternative mechanism for determining the amount of force or load being applied to rivet 49. As described below, while the time duration and magnitude of portions of these curves can vary by specific amounts, large deviations of these curves represent either a failure of the rivet set or a failure of the structure. As the system utilizes an average of "good" or acceptable sets histories to set an acceptable median load profile, the profile generated by the system is relatively independent of the orientation of sensor 33 on cast body 54 or the specific manufacturing environment of cast body 54. This is an improvement over other systems which use load cell and stroke length sensors to perform an interpretation of an independent load stroke curve.

An example is shown in 4*c* that shows a series of graphs resulting from rivet setting where rivet body lengths and mandrel break load have been varied to the extremes of manufacturing tolerance. For instance maximum rivet body length and minimum mandrel break load G1 shows a significant difference to nominal rivet body length and nominal mandrel break load G2. It is also significant that there has been setting tool jaw slip which has shifted the G7 curve away from the origin of the graph.

These graphs of the strain or pressure against distance or time show overlapping and changing shape of the lines. It is difficult to identify a consistent point or consistent points on these curves due to the apparently unstable nature of the curves. It is difficult to compare a rivet setting against a known and acceptable series or average of settings. It is noted that the above setting curves are typical for open-end blind rivets where the mandrel head enters the rivet body giving a characteristic two peaks to the curve as shown in FIG. 4*a*. These two peaks are usually designated Pe, Te and Ps, Ts for the mandrel head entry load and time and the mandrel setting load and time respectively.

For these cases of open-end blind rivet curves, one method of comparison is by continuously monitoring the output from the strain-measuring device and continuously comparing this data against a known rivet setting profile. In order to accommodate rivet manufacturing variations a tolerance is applied to the setting curves that is usually shown as a set of banding tolerance curves G3. Thus, for any new blind rivet being set, the resulting curves from this new setting should fall between the banding tolerance curves. While functional, the setting of banding curves to accommodate the variations of setting curves that result from rivets within normal manufacturing tolerances and the application pieces is difficult and may have to be set too wide. This wide tolerance banding will, thus accept settings which will otherwise be rejected if small differences of, for example, work piece grip thickness need to be identified.

Figure 4C:
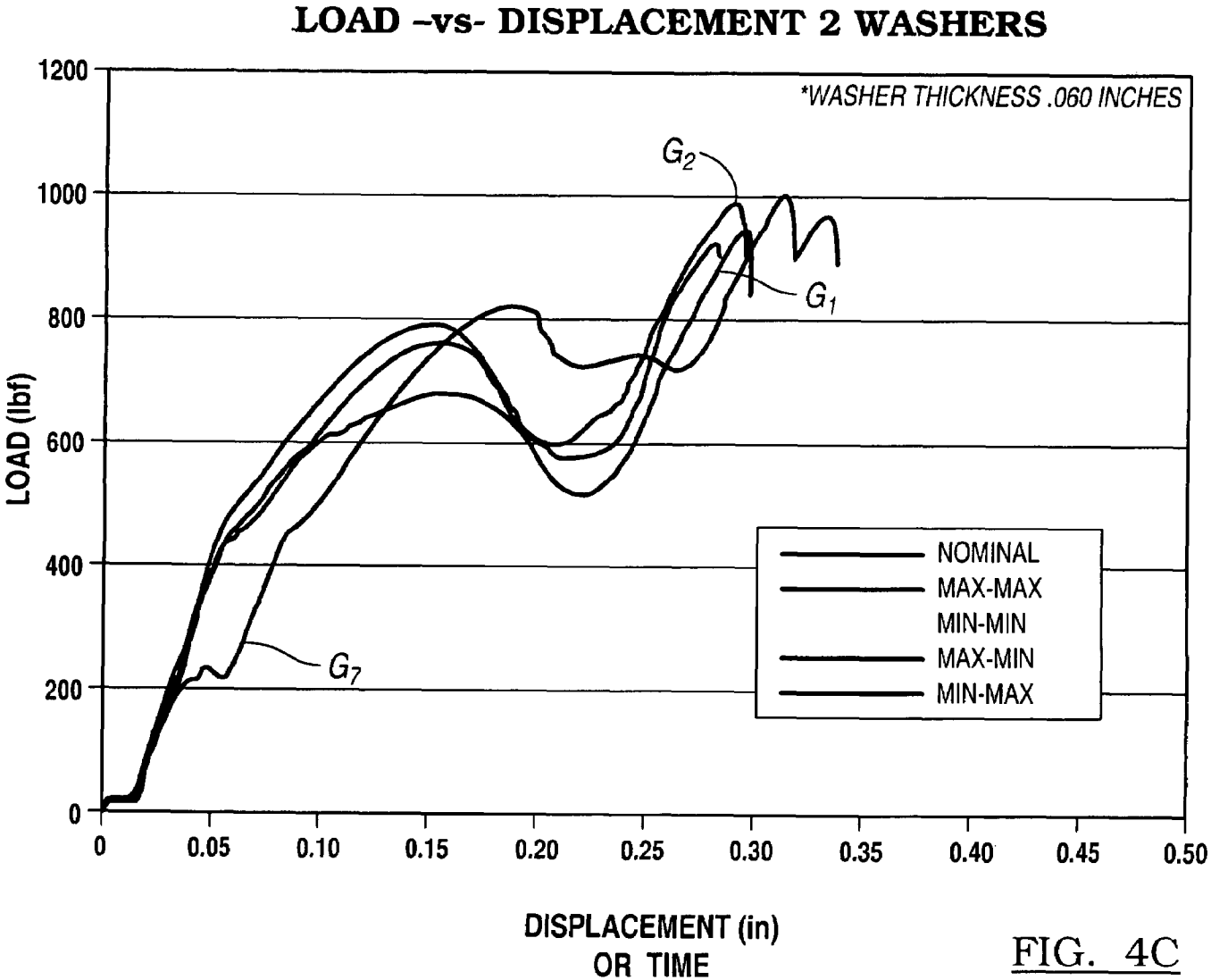

FIG. 4*c* represents a methodology to determine the tolerance bands. The force or pressure and time or distance co-ordinates from these subsequent blind rivet settings is monitored, data collated and compared against the reference curves. There are various conditions that may exist in the setting of blind rivets and these will be described separately with respect to FIG. 4*c* as follows:

The first condition is for the setting of a rivet that has nominal tolerances in terms of rivet body length and mandrel break load and has been set normally by a well prepared setting tool. This would be deemed to be a good setting in that the rivet curve stays within any developed tolerance zones.

The second condition is for the setting of a rivet that has maximum tolerances in terms of rivet body length and mandrel break load and has been set normally by a well prepared setting tool. This also would be deemed to be a good setting in that the rivet curve stays within any developed tolerance limits.

The third condition is for the setting of a rivet where the mandrel head has been manufactured to a size that is below specification but with otherwise nominal tolerances in terms of rivet body length and mandrel break load and has been set normally by a well prepared setting tool. This would be deemed to be a bad setting in that the rivet curve migrates from the desirable tolerance zones. In this instance, there is a high chance of the mandrel head pulling through the rivet body to give a poor rivet set.

Thus, it can be seen that the rivet must adhere to three separate criteria to be seen to have given a good setting. Firstly, the initial part of the curve must pass along the tolerance zone as this represents the initial work by the rivet. This is the clamping of the work piece plates together, the commencement and completion of hole filling. Further, this portion contains data related to when either mandrel head enters into the rivet body in the case of the open-end rivet or the commencement of the roll type setting in the case of the retained mandrel head type. These criteria are used to develop sets of rules regarding time or force tolerance bands.

To generate a baseline to compare the quality of rivets, a baseline rivet set curve is generated. This baseline can be easily generated by the machine for each particular rivet and set condition. FIG. 5 represents a statistically significant plurality of curves which are used to generate a preferred average strain or pressure versus time curves to be used by the system. Optionally, statistical techniques can be employed to determine if a sample load versus time curve is close enough to the meeting curve to determine if the specific curve is usable in formulating the meeting curve.

Once the baseline curve is developed, statistical techniques are used to set upper and lower tolerance bands. The system 32 also tracks the strain or pressure versus time data of each rivet set to determine if the system has created a potentially defective set. Several data analysis techniques are disclosed herein for determining if a particular rivet set is appropriate.

Figure 6A:
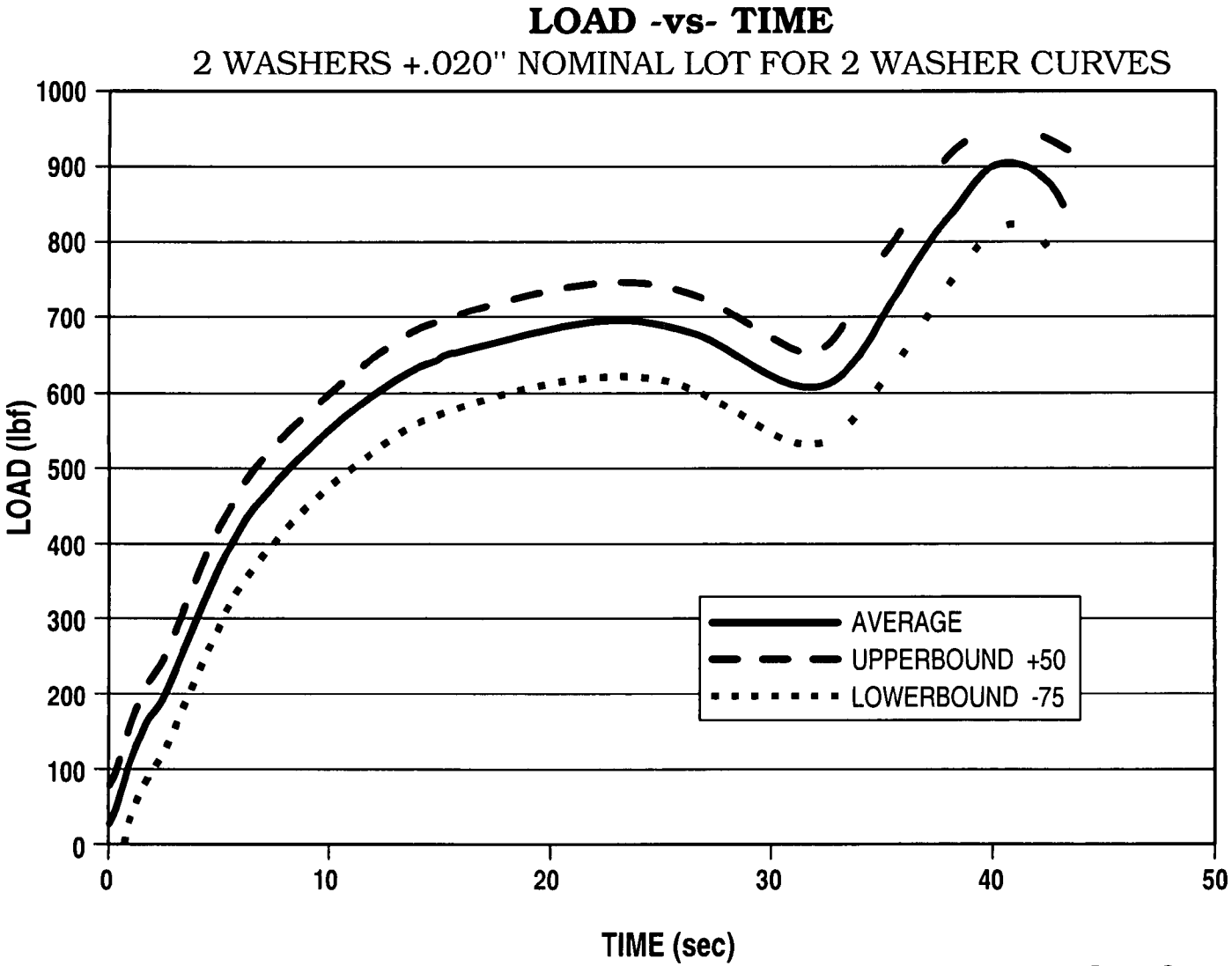
FIGS. 6*a* and 6*b* represent tolerance channels disposed about a example curve shown in FIG. 5.

FIG. 6*a* represents a tolerance curve or band disposed upon a median or example curve shown in FIG. 5. In this system, all portions of the median curve have the specific fixed size tolerance band defined around them. The system then tracks the strain or pressure versus time curves of an individual rivet set to determine whether it falls outside of the tolerance band. In case the rivet does fall outside of the specific tolerance band, an alarm or warning is presented to the line operator.

Figure 6B:
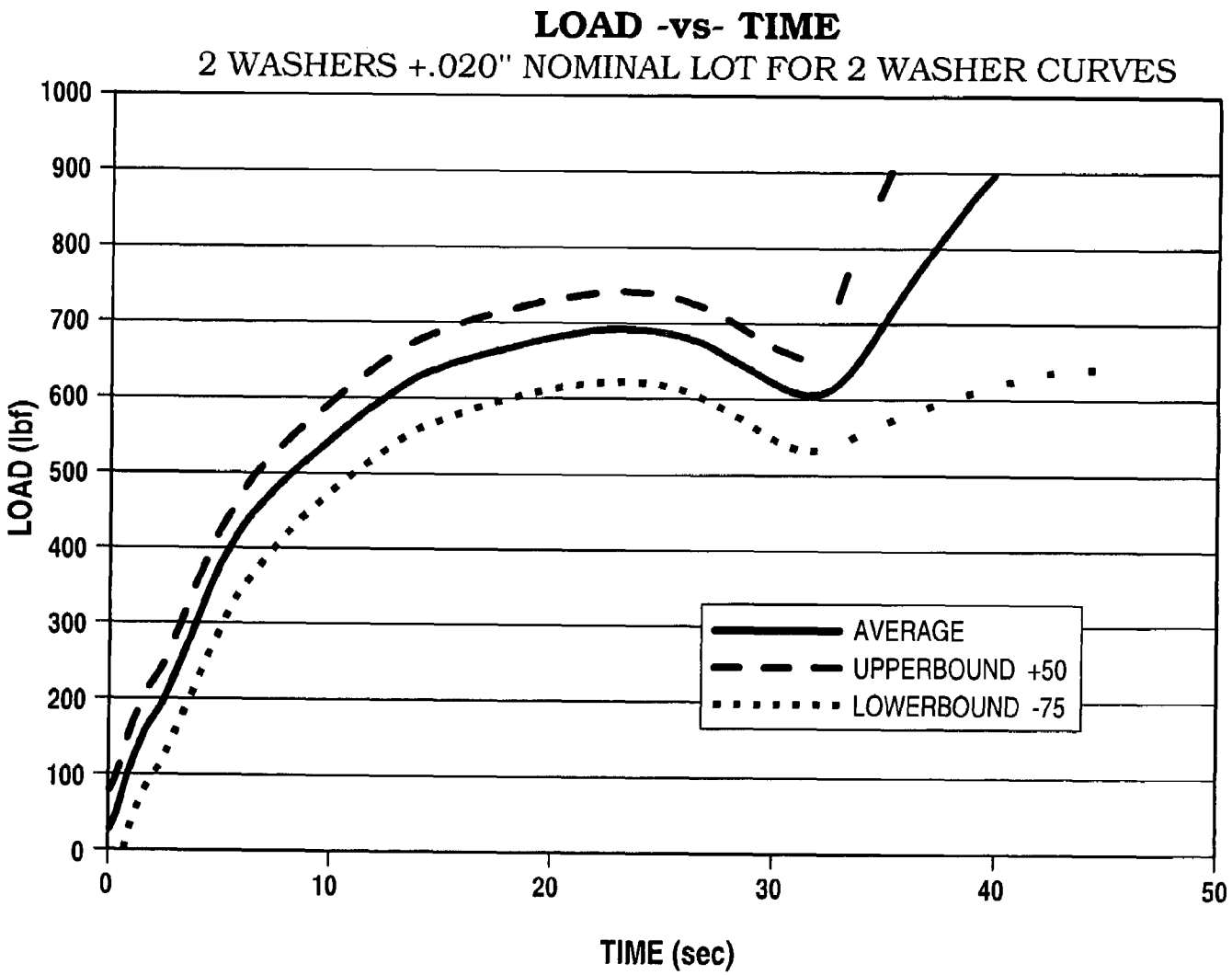

FIG. 6*b* represents an alternate tolerance channel or band for a rivet setting curve. Specifically, it should be noted that the varying tolerance heights depending on the portion of each curve. For example, during the initial sheet take up and deformation of the rivet body shown in the first portion of the curve, the tolerance band is set for a first value, but while the final hole filling and joint consolidation is taking place, the tolerance band is adjusted.

Figure 7:
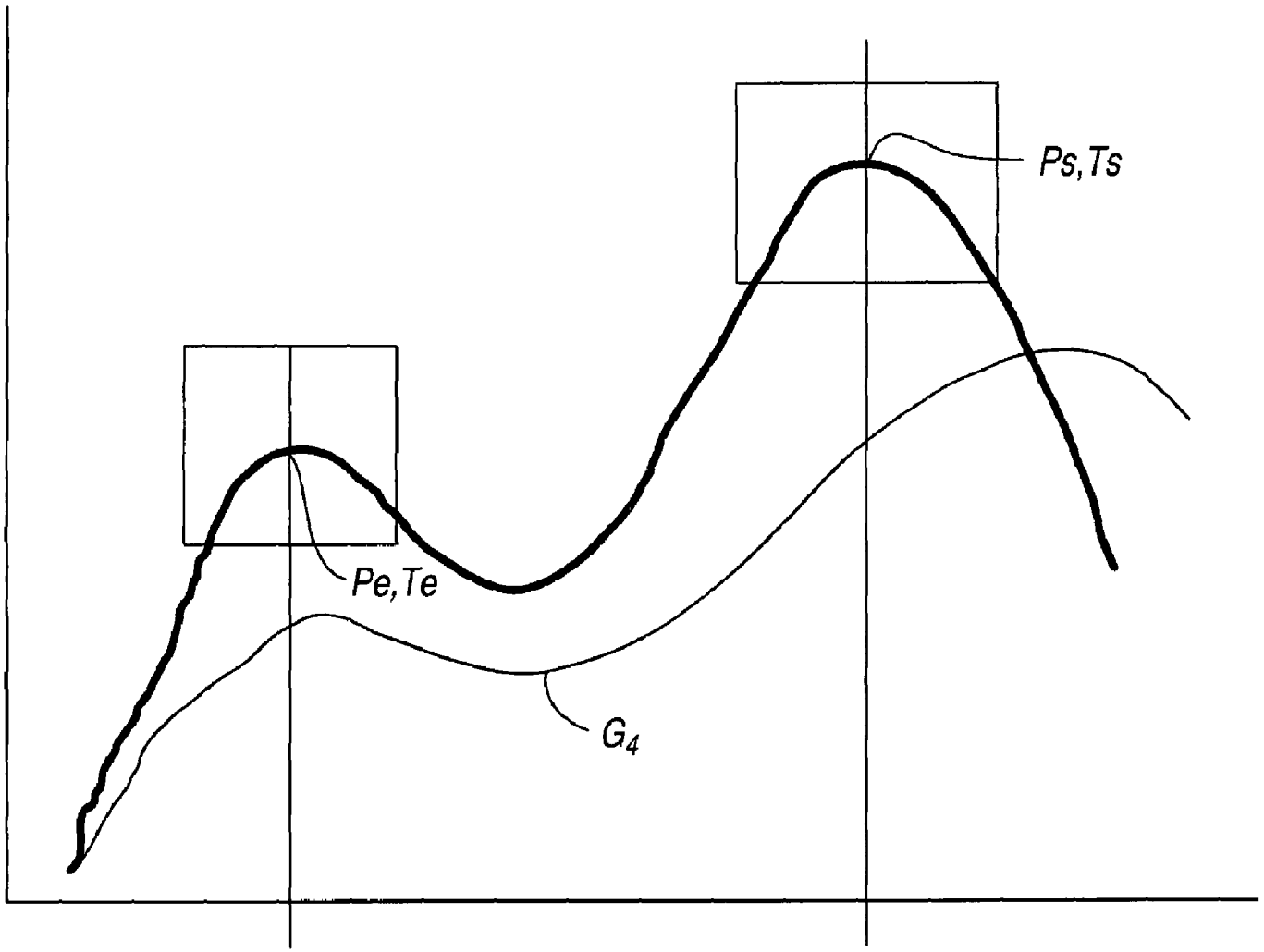
FIG. 7 represents the example curve shown in FIG. 5 having a pair of tolerance boxes disposed along specific locations of the curve.

As shown in FIG. 7, an alternate comparison method is to identify two coordinates or even one single co-ordinate such as the mandrel entry (Pe,Te) and mandrel break load (Ps,Ts) points or just the mandrel break (Ps,Ts) point and compare subsequent settings against these reference points. Again, to accommodate the variations normally occurring in the resultant setting curves, tolerances in time and strain are applied to these reference points giving a box through which the rivet setting curve for subsequent setting should pass.

For example, the first tolerance box is optionally equally disposed about a first local maximum (Pe, Te) which represents the completion of initial sheet take-up hole filling and the point at which the mandrel head enters the rivet body. The second tolerance box is centered at the location of the fracture of the rivet mandrel. This fracture is typically defined by the last local maximum of the curve which has a load above the first local maximum. Alternatively, this point may be the greatest strain detected. Curve G4 represents a rivet setting curve which falls outside of the acceptable tolerance box for the first and second location. It should be noted that there are several methods which can cause the rivet to fall outside of these boxes such as an incorrect stacking of components to be riveted together, the rivet hole size or an improper rivet head or improper functioning of the rivet setting tool.

Figure 8:
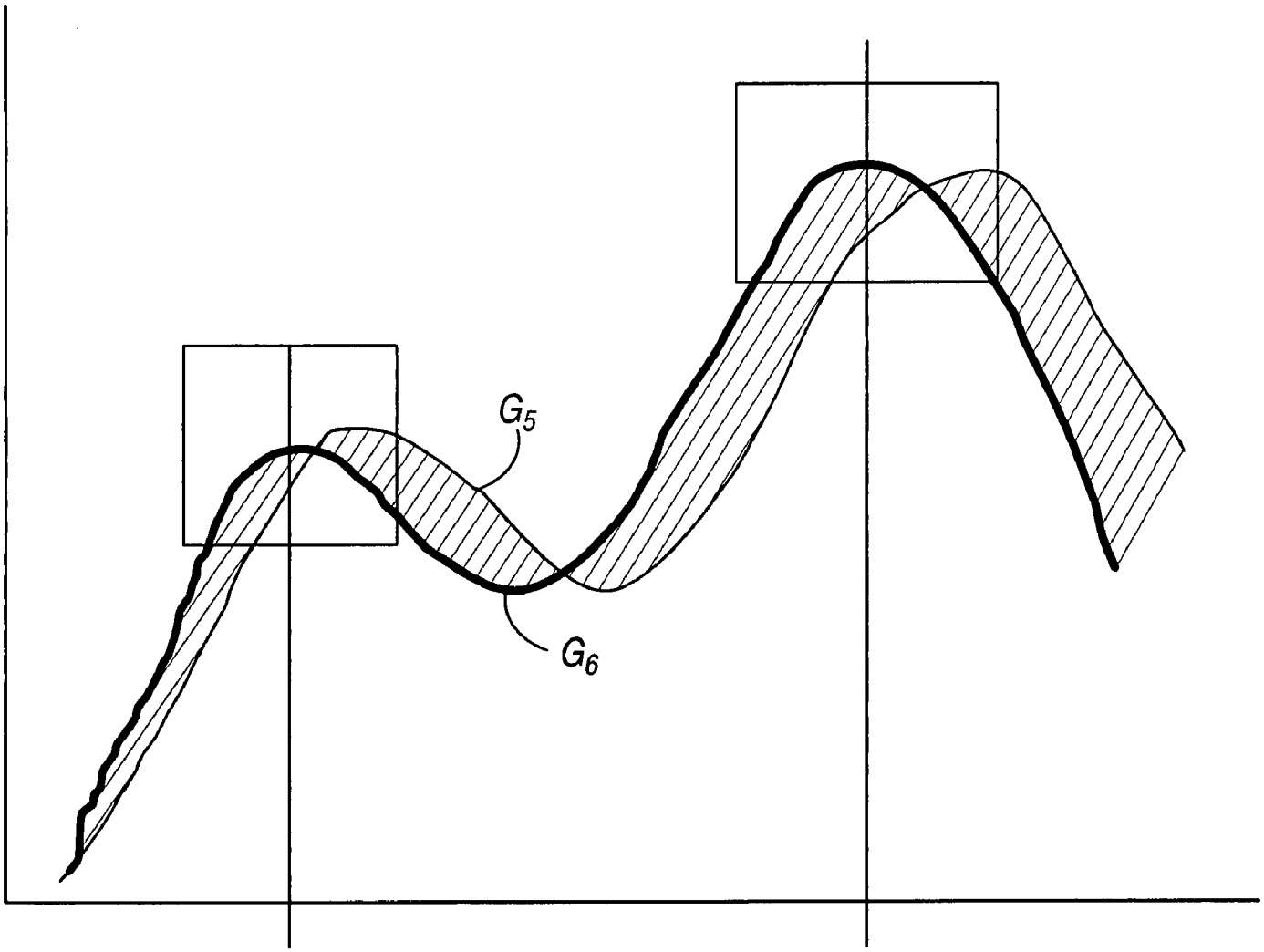
FIG. 8 represents a method utilizing a differential analysis of a rivet set compared to a new rivet set curve.

FIG. 8 represents an alternate method utilizing an integral analysis of a rivet set compared to a new rivet curve. In this regard, the difference between a particular rivet set G5 and the setting curve G6 is calculated. This is an absolute value differential analysis where the absolute value of the difference between the curves at a particular time is calculated and a time constant is used to calculate the area between the two curves. It should be noted that the difference between the curves can be utilized and calculated for different portions of the strain versus time or displacement curve. In this regard, data may be useful for the beginning portion of the curve up to the first local maximum. Additionally, the difference in area between the first and second local maximum may be useful. It is preferred that the system not calculate the differences in the areas between the curves after the last local maximum associated with the rivet break. Variations in the load versus time curve after the last local maximum are often times large and do not substantively contribute information to whether a particular rivet set is good. This is because the pressure or strain after the fracture of the rivet is not indicative of a good rivet set. It is envisioned that various integration techniques can be used including, but not limited to, pixel counting or Rieman Sums analysis.

Figure 9:
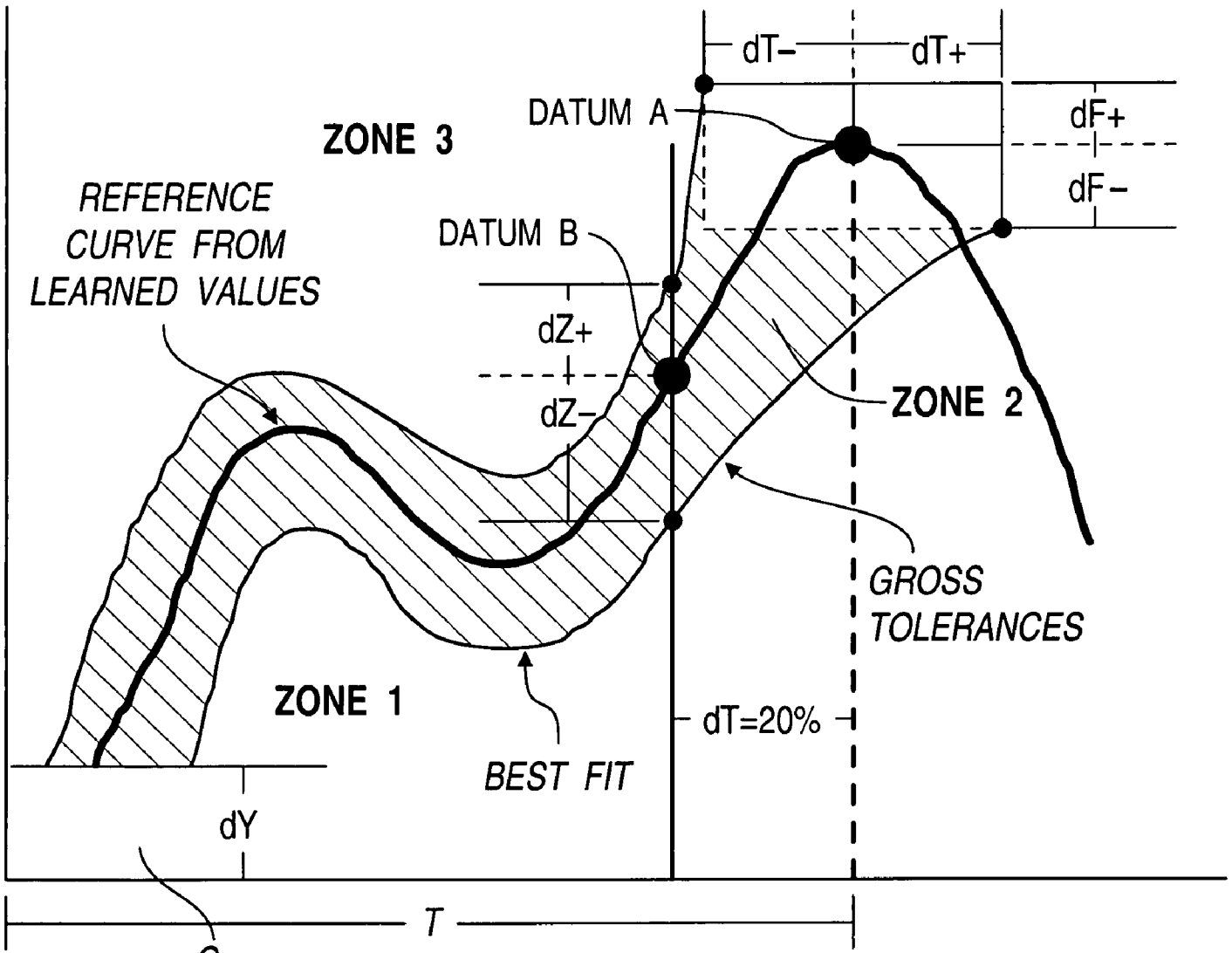
FIG. 9 represents a tolerance channel with a tolerance box used to compare curves.

FIG. 9 represents a medial curve that has applied to it a tolerance channel to the point at which the joint is consolidated and a tolerance box applied to the point at which the mandrel breaks. The first portions of the load versus time curve for a particular rivet set is compared to the first portion of the median curve. To complete a good rivet setting, the rivet setting curve is monitored and compared with the tolerance bands by the processor and the curve should fall within the predetermined band. Should a particular load versus time data for a particular rivet set either fall outside of the first tolerance band or the tolerance box, a fault is registered and an optical and audible alarm is indicated to the user.

It can be seen, therefore, that a typical reference graph will have a tolerance box positioned around the maximum mandrel break load point, a linear window between +/−dT and +/−dZ on the 80% vertical line and a tolerance area developed by the application of tolerances to the initial curve. It should also be noted that the initial part of the curves $C_1$ about the origin (called a "10% cut-off") is eliminated from any plotting or calculation as experience has taught that a low loads and times/displacements the resulting curves exhibit "noise" or irregular forms. This is due to such variations as initial jaw grip, the rivet flange seating against the nosepiece of the tool and perhaps slight aeration within the setting tool itself.

Figure 10:
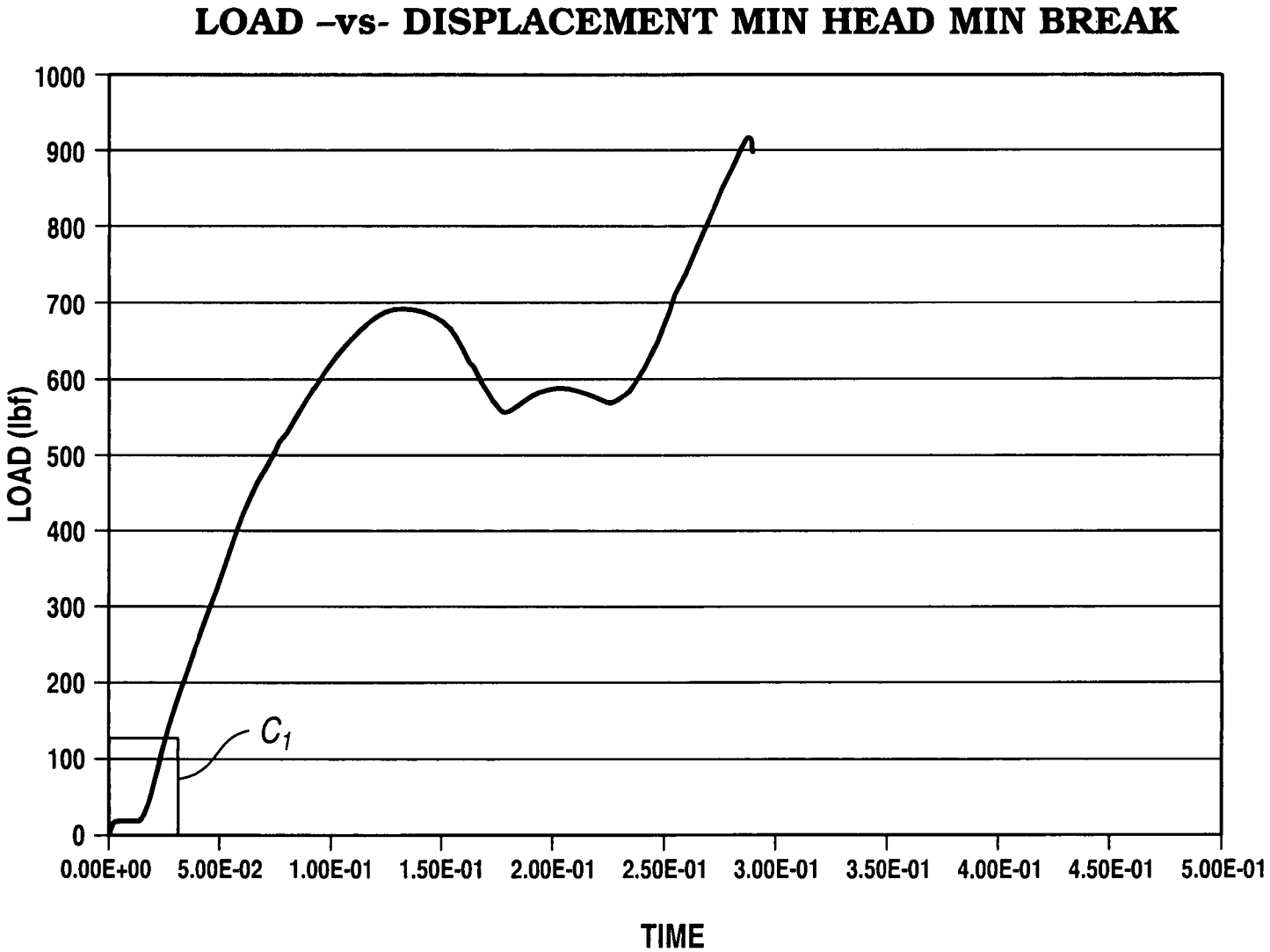
FIG. 10 represents an example curve utilizing a 10% cut-off.

FIG. 10 represents a standard time versus load curve for a rivet set with a 10% cutoff. As previously mentioned, the initiation portion of a rivet set event is a highly non-linear event having a significant amount of noise produced. By eliminating the first 10% of the curve from the analysis, a more accurate analysis can be conducted. The imposition of the arbitrary points that determine the 10% cut-off depends upon previous setting history and can be adjusted accordingly. This cut-off can be at a level of several milliseconds, for instance, from the zero of the original curve.

Figure 11:
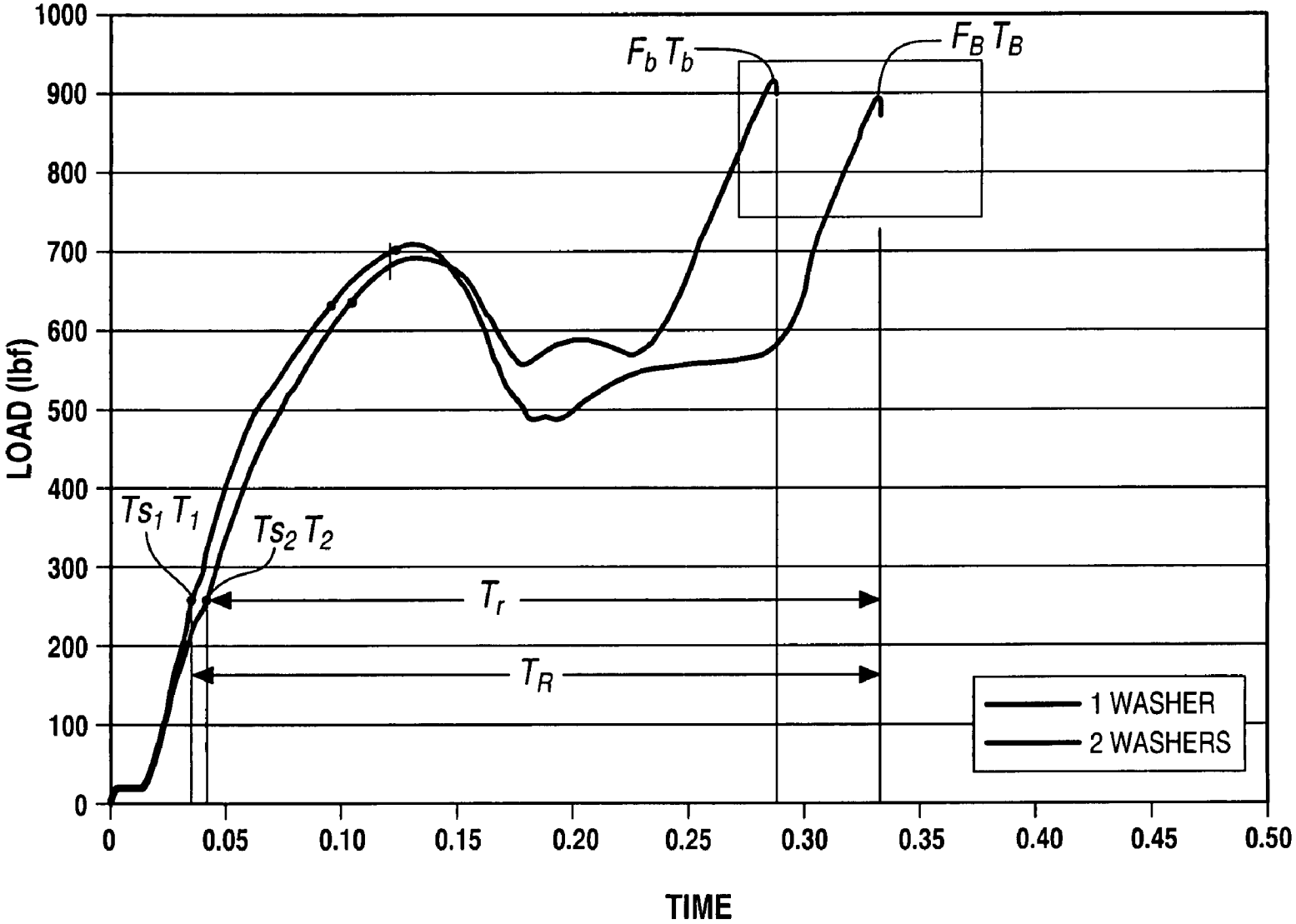
FIG. 11 represents a point and box system according to the teachings of the present invention.

FIG. 11 represents what is generally referred to herein as a point and box analysis method. The system incorporates a previously described reference or average curve. The value of the force $F_B$ and time $T_B$ at the last local maximum indicative of the mandrel break is determined. This break force is then multiplied by scaling factor K less than 1.0 to calculate a force $F_{S1}$. The system then determines where on the reference or median curve the force $F_{S1}$ is found and determines the time $T_1$ where the data correlates to this force. The system then calculates a reference time $T_R$ which equals to $T_B$-$T_1$. A tolerance box is then placed around $F_B$ and $T_B$ as previously described.

As with all of the previous examples, when evaluating a new rivet set, the system first initially aligns the subject data set to the data of the medial or reference curve. This occurs either by aligning the zero of the data sets as described, by aligning another feature such as the second or last local maximum, or aligning the first occurrence of a strain value (See FIG. 10). Once the data is aligned, it is determined if the data associated with the breaking of the mandrel falls within the acceptable tolerance box. If the data falls outside of the tolerance box, an alarm is initiated.

The system then determines force $F_b$ and time $T_b$ of the last local maximum associated with the subject data. This force $F_b$ is multiplied by the scaling factor K to determine a force $F_{S2}$. For the associated force $F_{S2}$, the time $T_2$ is $T_p$ determined and subtracted from the time associated with the rivet mandrel breakage to form $T_f$. The time $T_f$ is compared to the time $T_F$ to determine if it is within a predetermined time tolerance $T_T$. If the $T_F$ is within the tolerance band, then the rivet set is acceptable. It should be noted that the scaling factor K can be about 0.05 to about 0.6 and, more particularly, about 0.15 to about 0.45 and, most particularly, about 0.2.

Figure 12:
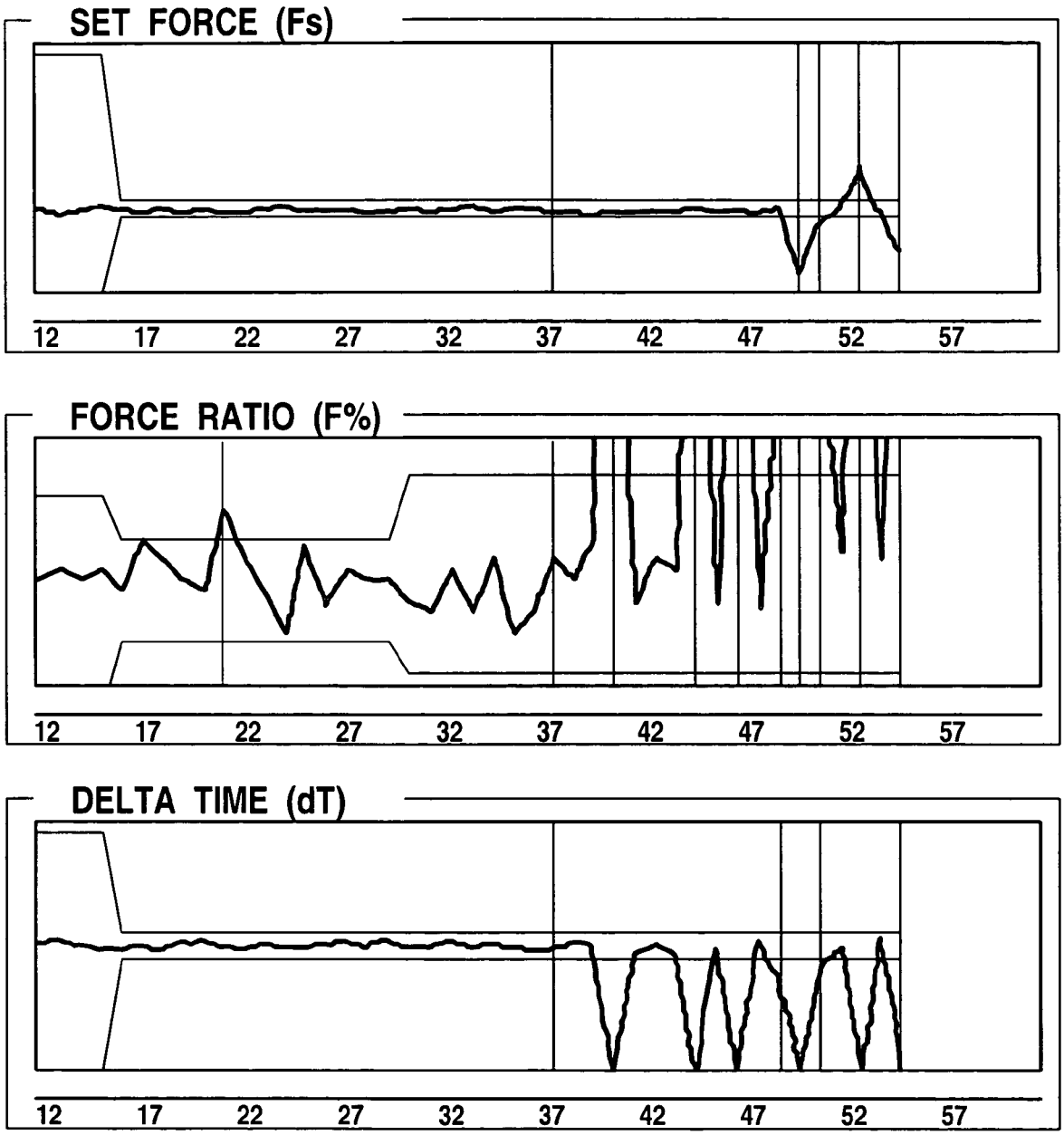
FIG. 12 represents quality checking of a series of rivet sets.

FIG. 12 represents a tracking quality of a series of rivets. As can be seen, a pair of tolerance bands is provided and there is an indication when a particular rivet does not meet a particular measured or calculated quality value. When a predetermined number of rivets in a row show a fault, the operator is alerted and instructed to determine whether there is likely a new lot of fasteners being used or whether a critical change has occurred to function of the equipment or the material being processed, which may require recalibration or changes of the system.

The above methods of comparison assume a random variation of manufacturing tolerances for the rivet and for the work piece. In practice, however, tolerances to the top or bottom of the range allowed can occur for one manufacturing batch and then move to the other extreme as new manufacturing tooling or a new production machine setting occurs. Thus a group of setting curves from a single batch of rivets may need to be made from a particular manufacturing batch. The resulting curves will show a set of values reflecting the size and strength of that batch. The batch may, however, have tolerances that will bias an average curve. For instance the batch may be related to maximum length and minimum break load and the average curve will reflect this trend. Thus in a production environment another batch of rivets could be a minimum length and maximum break load and thus fall outside of some of the tolerance bands of the reference rivets especially if they are set too close to the original curve. So in addition to the widening described above a further widening may also be necessary to accommodate the bias in the original learning curves. Tolerance bands that are set too wide thus increase the chance of accommodating either poor settings or undue rivet manufacturing variations.

A further complication can result from a type of rivet that has a retained mandrel whereby the mandrel head does not enter the rivet body on setting. (See FIG. 3*c*). The characteristic of the mandrel head entry point is no longer evident, and shows that making comparisons of setting curves is more difficult, especially as curves tend to be very similar and clearly any tolerance banding could mask a poor rivet setting.

Figure 13A:
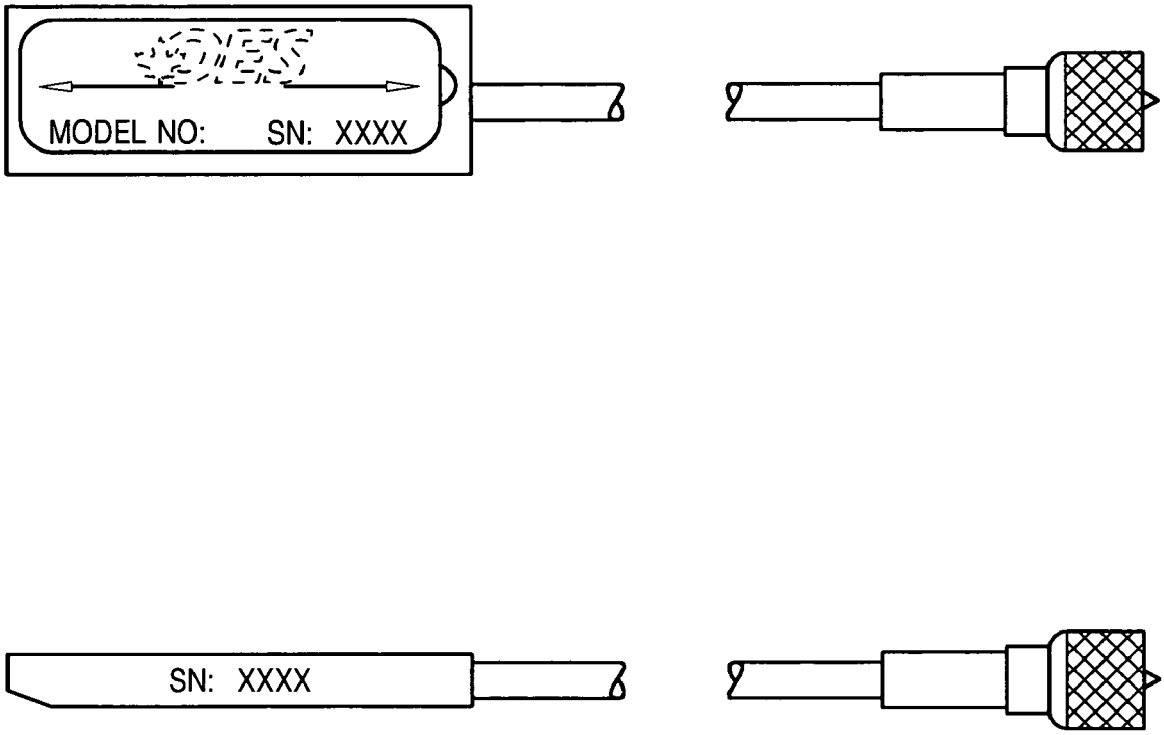
FIG. 13*a* represents elevational views showing a strain sensor in FIGS. 1*a*-2*b*.

FIG. 13*a* represents a sensor 33 which is configured to measure micro-strains. The sensor 33 is used to detect the micro-deflection in the tool housing. This micro-deflection within the housing can be measured in a standard power tool casing or nose housing or on the remotely intensified hydraulic tool housing. The output of the sensor data is stored in a memory location and retrieved through the use of an external computer 70. Data points are analyzed to produce graphs. The data from the computer is also optionally used to generate statistical process control information for the specific application.

Shown is the sensor 33*a* shown in the system FIGS. 1*a*-2*b*. Generally, the sensor is a flat micro-strain sensor having a frequency range from 0.5 to 100,000 Hz. The sensing element is formed of piezo-electric material and the housing material is preferably titanium having an epoxy seal.

Further according to the teachings of the present invention, a method for setting a fastener with a setting tool is presented. The method includes the step of first, defining a set of example strain/time data. A strain for a rivet setting process which is being evaluated is sensed. The sensed strain versus time data is aligned by time with the series of example strain/time data. The occurrence of the highest value of strain is used to identify the mandrel breakpoint of the measured strain/time data. This measured breakpoint strain value is compared with a predetermined desired breakpoint strain value. The measured strain/time signals are compared to the example strain/time signals.

In both the case of the example strain/time data and the measured strain/time data, graphs or wave forms based on these series in the time domain can be produced. These waveforms can be scanned for predetermined characteristics, which are used to align the data. As previously mentioned, this can be the highest detected strain, a predetermined strain, or may be another feature such as a first local maximum above a given strain value.

When monitoring the setting of a blind rivet, the axial strain within a cast body of rivet setting tool is monitored during a rivet setting process to produce a series of micro-strained signals related thereto. Each of these micro-strain signals is assigned an appropriate time value to produce an array of strain/time data. The initiation of the rivet setting process is defined as is the ending of the process. Optionally, this can be defined by a peak strain that correlates to the breaking of the mandrel. The total time of the rivet setting event is determined and compared with a predetermined desired value. In addition, the system can utilize the mandrel breaking load to determine whether it falls within a predetermined tolerance band around a predetermined strain value indicative of the breaking of the mandrel.

To form the example strain/time data, a statistically significant number of training strain measured signals are received and combined to form a representative curve. A tolerance band is defined with respect to the representative curve which is indicative a predetermined level of quality of the joint.

When the system is configured to monitor the supply pressure of the portion of the rivet setting process, the system applies a scaling factor, which is a function of the supply pressure to at least one of the strain or time data. In this regard, a series of functions are defined which relate to the varying supply pressures. These functions transform the strain versus time data into a series of transformed strain or pressure versus time data. Obviously, it is equally possible to transform either the example time versus strain data or the tolerance band in response to changes in the supply pressure, prior to the analysis to determine if the rivet set is acceptable.

Figure 13B:
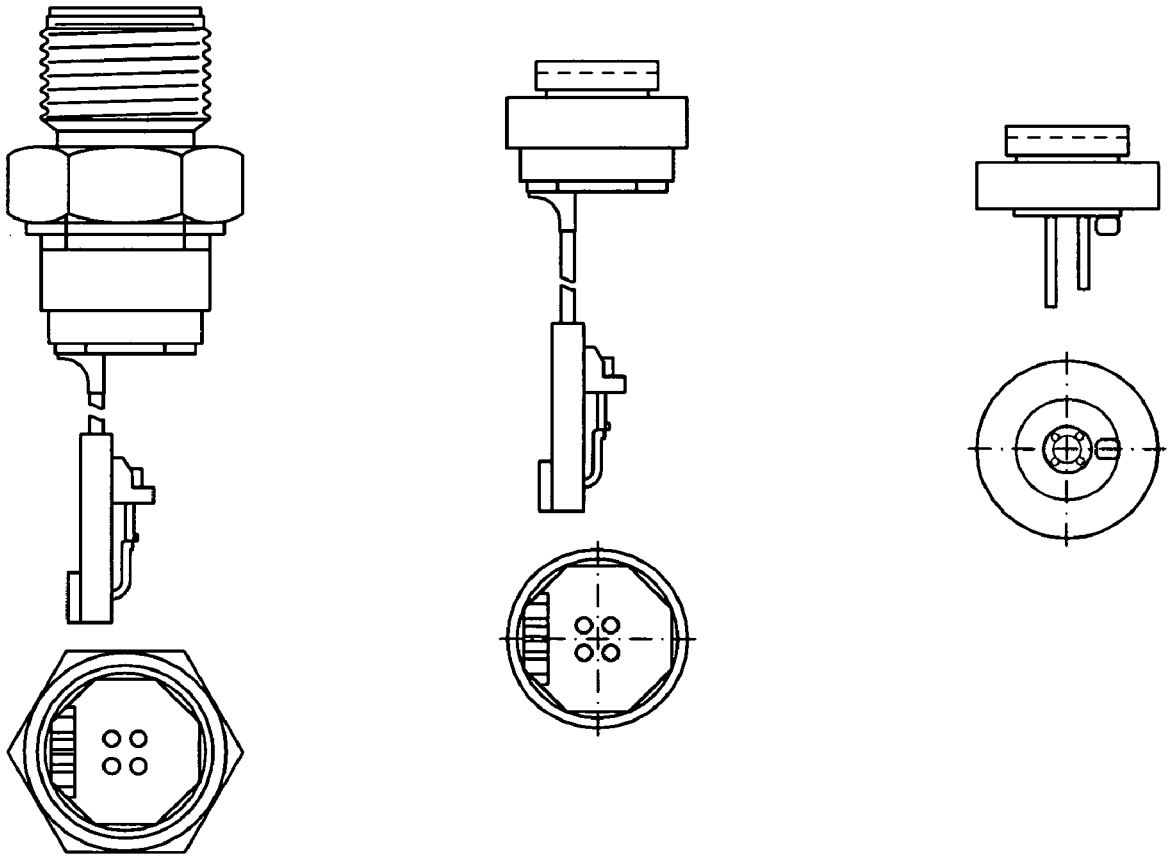
FIG. 13*b* represents the pressure sensor shown in FIG. 3.

FIG. 13*b* represents the pressure sensor shown in FIG. 3. The sensor is preferably a machined piezo-restrictive silicon pressure sensor mounted in a stainless steel package. An example of sensor 33' is available from ICSensors Model 87n Ultrastable.

During rivet manufacturing, rivet tolerances in terms of rivet body length and mandrel break load can vary from one end of the tolerance band to the other. This is a result of process variation as manufacturing tooling is changed, as different batches of raw materials are used and as the production tools are changed from one size of product to another. Accordingly, instead of imposing a nominal width of tolerance to the curves, a narrower band is applied for the open-end and retained mandrel head types respectively. This will have the affect of determining that only those rivets about a nominal rivet body length and application thickness and mandrel break load will be selected as good settings.

Should, however, rivets with minimum rivet body length and minimum mandrel break load be used as produced by another production set-up, then the population of curves will be at the bottom or even below the first and second tolerance bands. The computer processor will recognize this new pattern and providing the settings are deemed to be acceptable then the computer will reconfigure the average and apply the tolerance criteria about this new average. The computer will store the earlier average curve data.

Should, however, rivets with maximum rivet body length and maximum mandrel break load be used as produced by another change of production parameters, then the population of curves leave a particular tolerance band after a predetermined number of failures. The computer processor will again recognize this further new pattern and, providing the settings are deemed to be acceptable, then the computer processor will reconfigure the average and apply the tolerance criteria about this further new average. Again the computer processor will store the earlier average data.

Thus, where a batch of mixed work with differing tolerances are applied, then the computer processor can select either the nominal reference curve or the lower curve or the higher curve to compare subsequent settings. If, however, the rivet settings fall outside these three reference curves, the setting is deemed to have failed.

Preferences are built into the system where perhaps the operator can reset and repeat the setting once the old rivet has been removed but at each stage the events are recorded and form part of the quality assurance for that particular job. In a second arrangement of the proposed system it is proposed that a self-learning program be applied as a continuous process as will be described below. It can be seen that the tolerances that are applied to the reference curve at the positions X and Y to make a tolerance band and the choosing of 80% of the work done to determine the vertical reference line for X and Y are arbitrarily chosen.

FIG. 14 represents a strain vs. time chart of showing the effects of changes of supply pressure on a rivet set process. Curve C1 is a strain vs. time curve from the sensors 33 when the supply pressure is at a pressure P1. Curve C2 is a strain vs. time curve from the sensors 33 when the supply pressure is at a pressure P2. As can be seen, the time duration of the rivet set event as depicted by C2 with supply pressure P2 is longer than the duration of the rivet set event depicted by curve C1. The rivet sets events depicted by both curves, represent acceptable quality rivet sets. The pressure sensor 37, which is configured to measure subtle changes in the supply pressure at the time a rivet set process is initiated provides an output which is used by a processor 70. The processor 70 applies a scaling factor, which is a function of the supply pressure, to an array of data characterized by (time and strain) from the strain sensor 33 to normalize the data to form an array of data as depicted as C3. It is envisioned that a first scaling factor S1 can be applied to the Strain or Force component of the measurement and/or a second scaling factor S2 can be applied to the time component of the measurement. In this regard, the array of data is shifted prior to being analyzed as discussed above.

Alternatively, it is envisioned that the system which utilizes line pressure to apply a function to measured data can be used with respect to fastener setting machines that utilize signals received from pressure sensors which measure the pressure of working fluids within the tool or force transducers which measure the force applied to a fastener. In this regard, the transformation of measured data can occur for any measured data that is taken with respect to time. In this way, the system will be configured to conduct fastener set verification which is independent of the drive line pressure and further independent of the speed of a force transmitting member within the tool.

The advantage of the aforementioned systems is that they are entirely flexible once it has collected the data. They can provide complete assurance that every rivet has been set correctly by comparing the setting profile against the operational profile. They can provide information that all rivets have been set in the correct holes and the correct grip thickness. They can monitor the number of rivets set and also tell if a rivet has been free-set. They can also monitor wear of the tool setting jaws by comparing the setting profile up to mandrel entry load and comparing against elapsed time. The systems can also advantageously provide factory management data on build rate and production efficiency and link number of rivets used to an automatic rivet reordering schedule. Furthermore, they can be attached to fully automatic rivet setting tools and thus provide the assurance and insurance that the assembly has been completed in accordance to plan.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

It is further envisioned that various aspects of the present invention can be applied to other types of rivet machines, for example, the system can be used with self-piercing rivets, although various advantages of the present invention may not be realized. Further, the system can be used to set various types of fasteners, for example, multiple piece fasteners, solid fasteners, clinch fasteners or studs. The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A rivet setting system comprising:

a rivet setting tool, said tool including a rivet engaging assembly;

a strain sensor comprising at least one transducer for monitoring strains within a portion of a rivet setting tool body during a rivet setting process and producing a strain output signal related thereto; and a control circuit configured to:

(a) receive a statistically significant series of training output signals from the sensor from setting a statistically significant number of rivets;

(b) align the series of training output signals to form a series of output/time predetermined value pairs;

(c) form an example set of output/time signals; and (d) define a tolerance band about the output/time signals value pairs.

2. The rivet setting system of claim 1 wherein said control circuit further includes circuitry configured to:

produce from said series of strain output signals having associated time values over the rivet setting process, a measured strain-versus-time waveform;

produce from said predetermined set of output signals to form an example strain-versus-time waveform;

scan said measured strain-versus-time waveform to determine a first last local maximum strain value;

scan said example strain-versus-time waveform to determine a second last local maximum strain value; and determine if the first last local maximum strain value and the second last local maximum strain value is within a predetermined tolerance band.

3. The system of claim 1 wherein the strain sensor is configured to measure strain in an axial direction.

4. The rivet setting system of claim 1 further including an indicator operatively connected to said control circuit for signaling to an operator the acceptability of the set based on comparison with said strain output/predetermined value pairs.

5. The system of claim 1 wherein a first transducer is a micro-strain sensor.

6. The system of claim 1 wherein said control circuit includes an integrator, a comparator connected with said integrator, and a programmable memory connected with said comparator.

7. The system of claim 1 wherein the body is a cast structure.

8. The system of claim 7 wherein the sensor is positioned on an exterior surface of the cast body.

9. The system according to claim 7 wherein the body defines a sensor mounting location and the cast body has a predetermined thickness beneath the sensor mounting location.

10. A rivet setting machine comprising:

a rivet setting tool having a body portion;

a strain sensor coupled to the body portion of the tool, said strain sensor configured to measure strains within a body portion during a rivet setting event;

a monitoring circuit configured to:

(a) receive a number of training output signals from the strain sensor from a series of rivet setting events;

(b) combine the training output signals to form a representative array of data; and (c) define a plurality of tolerance bands about the representative data, wherein the body comprises a nose housing and wherein the strain sensor is coupled to the nose housing.

11. The rivet setting machine of according to claim 10 wherein the nose housing is coupled to the body via a coupling portion and the sensor is positioned adjacent the coupling portion.

12. The rivet setting tool according to claim 10 wherein said tool comprises a quick change nose having an adapter and the nose housing, said adapter being fixedly engaged to a body and wherein the nose housing is removeably coupled to the adaptor.

13. The rivet setting machine according to claim 12 wherein the sensor is disposed on said body adjacent the adapter.

14. The rivet setting machine according to claim 12 wherein the adapter is configured to transfer loads from the nose housing to the body during the setting of a rivet.

15. The rivet setting machine according to claim 12 further comprising a mechanism configured to apply a force to couple the nose housing to the adapter.

16. The rivet setting machine according to claim 15 wherein the output signal of the sensor is independent from the force applied by the mechanism.

17. The rivet setting machine according to claim 15 wherein the mechanism is a threaded member configured to engage threads formed on a surface of the adapter.

18. The rivet setting machine according to claim 15 wherein the body defines a counter bore and wherein the position of said sensor is adjacent the counter bore.

19. A system for setting a rivet fastener and evaluating the acceptability of a setting event, comprising:

a rivet setting machine having a first member configured to apply a force to a mandrel of the rivet;

a second member configured to apply a reaction force to the rivet; and a sensor configured to measure strain in the second member caused by a moment induced by the reaction force, wherein said second member is removably couplable to the first member, and wherein the strain sensor is configured to measure strain which is a first radial distance away from the second member.

20. The system according to claim 19 wherein the force is applied through a first axis.

* * * * *